US008753789B2

(12) United States Patent
Ogaki et al.

(10) Patent No.: US 8,753,789 B2
(45) Date of Patent: Jun. 17, 2014

(54) ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

(75) Inventors: Harunobu Ogaki, Suntou-gun (JP); Kazunori Noguchi, Suntou-gun (JP); Atsushi Okuda, Yokohama (JP); Shio Murai, Toride (JP); Kazuhisa Shida, Mishima (JP); Takashi Anezaki, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 13/576,149

(22) PCT Filed: Aug. 18, 2011

(86) PCT No.: PCT/JP2011/069096

§ 371 (c)(1),
(2), (4) Date: Jul. 30, 2012

(87) PCT Pub. No.: WO2012/035944

PCT Pub. Date: Mar. 22, 2012

(65) Prior Publication Data

US 2012/0301181 A1 Nov. 29, 2012

(30) Foreign Application Priority Data

Sep. 14, 2010 (JP) ..... 2010-205832

(51) Int. Cl.
*G03G 5/05* (2006.01)
*G03G 5/06* (2006.01)

(52) U.S. Cl.
USPC ..... 430/58.85; 430/58.65; 430/59; 430/134; 399/111; 399/159

(58) Field of Classification Search
USPC ..... 430/58.85, 58.65, 59.6, 134; 399/111, 399/159
See application file for complete search history.

(56) References Cited

U.S. PATENT DOCUMENTS 5,834,146 A * 11/1998 Hoshizaki et al. ..... 430/58.5
6,136,521 A 10/2000 Hikosaka et al.
6,451,493 B1 9/2002 Omokawa et al.
6,535,710 B2 3/2003 Takeshima et al.
6,991,881 B2 1/2006 Ogaki et al.
6,994,941 B2 2/2006 Tanaka et al.
7,001,699 B2 2/2006 Tanaka et al.
7,045,261 B2 5/2006 Tanaka et al.
7,171,142 B2 1/2007 Kawakami et al.
7,413,840 B1 8/2008 Ogaki et al.
7,551,878 B2 6/2009 Ogaki et al.
7,553,594 B2 6/2009 Ogaki et al.
7,556,901 B2 7/2009 Anezaki et al.
7,585,604 B2 9/2009 Ogaki et al.
7,622,238 B2 11/2009 Uematsu et al.
7,629,102 B2 12/2009 Ochi et al.
7,645,547 B2 1/2010 Okuda et al.
7,655,370 B2 2/2010 Kitamura et al.
7,704,657 B2 4/2010 Uesugi et al.
7,718,331 B2 5/2010 Uematsu et al.
7,749,667 B2 7/2010 Kawahara et al.
7,799,496 B2 9/2010 Uesugi et al.
7,838,190 B2 11/2010 Ogaki et al.
7,875,410 B2 1/2011 Ogaki et al.
7,901,855 B2 3/2011 Ogaki et al.

(Continued)

FOREIGN PATENT DOCUMENTS

JP 10-232503 A 9/1998
JP 2001-337467 A 12/2001

(Continued)

OTHER PUBLICATIONS

English language machine translation of JP 2004-177560 (Jun. 2004).*

(Continued)

*Primary Examiner* — Christopher Rodee
(74) *Attorney, Agent, or Firm* — Fitzpatrick, Cella, Harper and Scinto

(57) ABSTRACT

An electrophotographic photosensitive member comprises a charge-transporting layer which is a surface layer of the electrophotographic photosensitive member; wherein the charge-transporting layer has a matrix-domain structure having: a matrix comprising: at least one resin selected from the group consisting of a polycarbonate resin C and a polyester resin D; and at least one charge-transporting substance selected from the group consisting of a compound represented by the following formula (1) and a compound represented by the following formula (1'), and a domain comprising a polycarbonate resin A.

(1)

(1')

6 Claims, 1 Drawing Sheet

(56) References Cited

U.S. PATENT DOCUMENTS

| | | | | |
|---|---|---|---|---|
| 7,927,774 | B2 | 4/2011 | Ogaki et al. | |
| 7,931,848 | B2 | 4/2011 | Ochi et al. | |
| 2010/0092208 | A1* | 4/2010 | Ogaki et al. | 399/111 |
| 2011/0158683 | A1 | 6/2011 | Okuda et al. | |
| 2011/0177438 | A1 | 7/2011 | Noguchi et al. | |
| 2012/0099898 | A1 | 4/2012 | Ochi et al. | |
| 2012/0114375 | A1 | 5/2012 | Fujii et al. | |
| 2012/0225381 | A1 | 9/2012 | Nakamura et al. | |

FOREIGN PATENT DOCUMENTS

| | | | |
|---|---|---|---|
| JP | 2002-182406 | A | 6/2002 |
| JP | 2004-177560 | A | 6/2004 |
| WO | 2010/008095 | A1 | 1/2010 |

OTHER PUBLICATIONS

English language machine translation of JP 2002-182406 (Jun. 2002).*

Anezaki, et al., U.S. Appl. No. 13/577,608, 371(c) Date: Aug. 7, 2012.

PCT International Search Report and Written Opinion of the International Searching Authority, International Application No. PCT/JP2011/069096, Mailing Date Sep. 27, 2011.

* cited by examiner

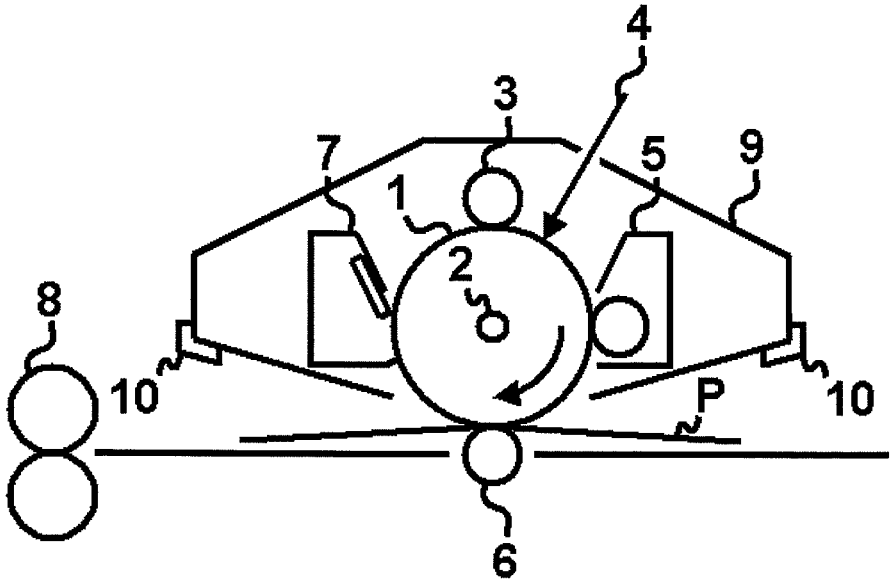
4
3
7
5
9
1
2
8
10
10
P
6

ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

TECHNICAL FIELD

The present invention relates to an electrophotographic photosensitive member, a process cartridge, an electrophotographic apparatus, and a method of manufacturing an electrophotographic photosensitive member.

BACKGROUND ART

An organic electrophotographic photosensitive member (hereinafter, referred to as "electrophotographic photosensitive member") containing an organic charge-generating substance (organic photoconductive substance) is known as an electrophotographic photosensitive member mounted on an electrophotographic apparatus. In an electrophotographic process, a variety of members such as a developer, a charging member, a cleaning blade, paper, and a transferring member (hereinafter, also referred to as "contact members or the like") have contact with the surface of the electrophotographic photosensitive member. Therefore, the electrophotographic photosensitive member is required to reduce generation of image deterioration due to contact stress with such contact members or the like. In particular, in recent years, the electrophotographic photosensitive member is required to have a sustained effect of reducing the image deterioration due to contact stress with improvement of durability of the electrophotographic photosensitive member.

For sustained reduction of contact stress, Patent Literature 1 has proposed a method of forming a matrix-domain structure in the surface layer using a siloxane resin obtained by integrating a siloxane structure into a molecular chain. In particular, the literature shows that use of a polyester resin integrated with a specific siloxane structure can achieve an excellent balance between sustained reduction of contact stress and potential stability (suppression of variation) in repeated use of the electrophotographic photosensitive member.

On the other hand, there has been proposed a technology for adding a siloxane-modified resin having a siloxane structure in its molecular chain to a surface layer of an electrophotographic photosensitive member. Patent Literature 2 and Patent Literature 3 have each proposed an electrophotographic photosensitive member containing a polycarbonate resin integrated with a siloxane structure having a specific structure, and effects such as contamination prevention and filming prevention caused by releasing effect have been reported.

The electrophotographic photosensitive member disclosed in Patent Literature 1 has an excellent balance between sustained reduction of contact stress and potential stability in repeated use. However, the inventors of the present invention have made studies, and as a result, the inventors have found that, in the case of using a charge-transporting substance having a specific structure as a charge-transporting substance, the potential stability in repeated use can further be improved.

In the electrophotographic photosensitive member including a surface layer containing a siloxane-modified resin having a siloxane structure in its molecular chain, disclosed in each of Patent Literature 2 and Patent Literature 3, a balance between sustained reduction of contact stress and potential stability in repeated use cannot be achieved.

CITATION LIST

Patent Literature

PTL 1: International Patent WO 2010/008095A

PTL 2: Japanese Patent Application Laid-Open No. H10-232503

PTL 3: Japanese Patent Application Laid-Open No. 2001-337467

SUMMARY OF INVENTION

Technical Problem

An object of the present invention is to provide an electrophotographic photosensitive member containing a specific charge-transporting substance, which has an excellent balance between sustained reduction of contact stress with a contact member or the like and potential stability in repeated use. Another object of the present invention is to provide a process cartridge having the electrophotographic photosensitive member and an electrophotographic apparatus having the electrophotographic photosensitive member. A further object of the present invention is to provide a method of manufacturing the electrophotographic photosensitive member.

Solution to Problem

The above-mentioned objects are achieved by the following present invention.

An electrophotographic photosensitive member, comprising: a conductive support, a charge-generating layer which is provided on the conductive support and comprises a charge-generating substance, and a charge-transporting layer which is provided on the charge-generating layer and is a surface layer of the electrophotographic photosensitive member; wherein the charge-transporting layer has a matrix-domain structure having: a domain comprising a polycarbonate resin A having a repeating structural unit represented by the following formula (A) and a repeating structural unit represented by the following formula (B); and a matrix comprising: at least one resin selected from the group consisting of a polycarbonate resin C having a repeating structural unit represented by the following formula (C) and a polyester resin D having a repeating structural unit represented by the following formula (D), and at least one charge-transporting substance selected from the group consisting of a compound represented by the following formula (1) and a compound represented by the following formula (1'); wherein the content of a siloxane moiety in the polycarbonate resin A is not less than 5% by mass and not more than 40% by mass relative to the total mass of the polycarbonate resin A;

(A)

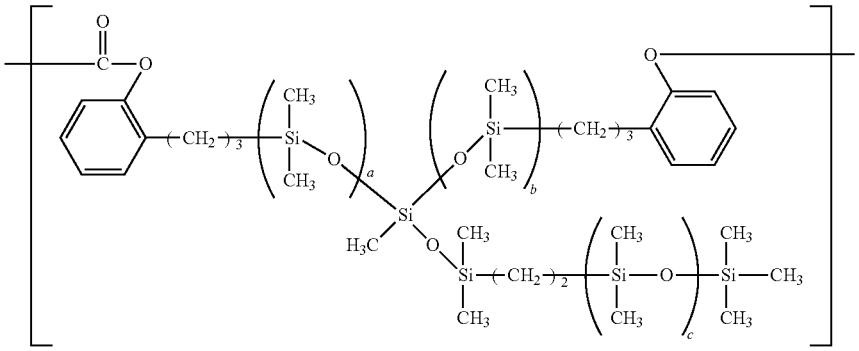

wherein, in the formula (A), "a", "b", and "c" each independently represents the number of repetitions of a structure within the brackets, an average of "a" in the polycarbonate resin A ranges from 1 to 10, an average of "b" in the polycarbonate resin A ranges from 1 to 10, and an average of "c" in the polycarbonate resin A ranges from 20 to 200;

(B)

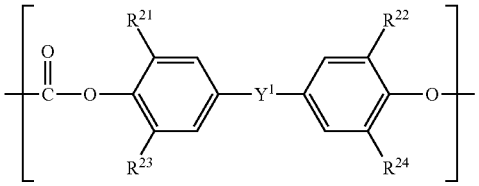

wherein, in the formula (B), $R^{21}$ to $R^{24}$ each independently represents a hydrogen atom, or a methyl group, and $Y^1$ represents a single bond, a methylene group, an ethylidene group, a propylidene group, a phenylethylidene group, a cyclohexylidene group, or an oxygen atom (C)

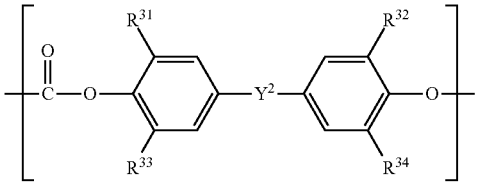

wherein, in the formula (C), $R^{31}$ to $R^{34}$ each independently represents a hydrogen atom, or a methyl group, and $Y^2$ represents a single bond, a methylene group, an ethylidene group, a propylidene group, a phenylethylidene group, a cyclohexylidene group, or an oxygen atom;

(D)

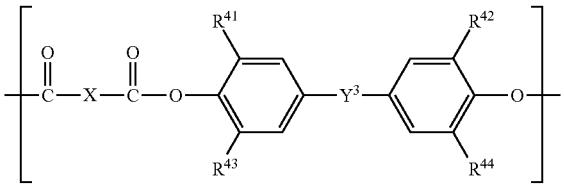

wherein, in the formula (D), $R^{41}$ to $R^{44}$ each independently represents a hydrogen atom, or a methyl group, X represents a meta-phenylene group, a para-phenylene group, or a bivalent group having two para-phenylene groups bonded with an oxygen atom, and $Y^3$ represents a single bond, a methylene group, an ethylidene group, a propylidene group, a cyclohexylidene group, or an oxygen atom; and (1)

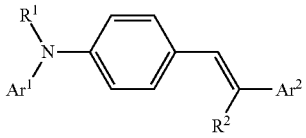

(1')

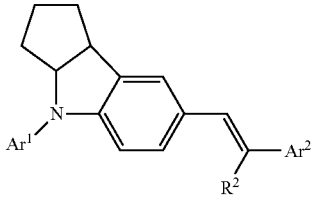

wherein, in the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with an univalent group represented by the formula "—CH═$(Ar^3)Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group.

The present invention also relates to a process cartridge detachably attachable to a main body of an electrophotographic apparatus, wherein the process cartridge integrally supports: the electrophotographic photosensitive member; and at least one device selected from the group consisting of a charging device, a developing device, a transferring device, and a cleaning device.

The present invention also relates to an electrophotographic apparatus, comprising: the electrophotographic photosensitive member; a charging device; an exposing device; a developing device; and a transferring device.

Advantageous Effects of Invention

According to the present invention, it is possible to provide the electrophotographic photosensitive member containing a specific charge-transporting substance, which has an excellent balance between sustained reduction of contact stress with a contact member or the like and potential stability in repeated use. Moreover, according to the present invention, it is also possible to provide the process cartridge having the electrophotographic photosensitive member and the electrophotographic apparatus having the electrophotographic photosensitive member. Further, according to the present invention, it is also possible to provide the method of manufacturing the electrophotographic photosensitive member.

BRIEF DESCRIPTION OF DRAWING

FIGURE is a diagram that schematically shows the construction of an electrophotographic apparatus including a process cartridge having an electrophotographic photosensitive member of the present invention.

DESCRIPTION OF EMBODIMENTS

As described above, an electrophotographic photosensitive member of the present invention includes: a conductive support, a charge-generating layer which is provided on the conductive support and comprises a charge-generating substance, and a charge-transporting layer which is provided on the charge-generating layer and is a surface layer of the electrophotographic photosensitive member, in which the charge-transporting layer has a matrix-domain structure having: a matrix including: at least one resin selected from the group consisting of a polycarbonate resin C having a repeating structural unit represented by the formula (C) and a polyester resin D having a repeating structural unit represented by the formula (D) (hereinafter, also referred to as component [β]); and at least one charge-transporting substance selected from the group consisting of a compound represented by the formula (1) and a compound represented by the formula (1') (hereinafter, also referred to as component [γ]); and a domain including a polycarbonate resin A having a repeating structural unit represented by the formula (A) and a repeating structural unit represented by the formula (B) (hereinafter, also referred to as component [α]).

When the matrix-domain structure of the present invention is compared to a "sea-island structure", the matrix corresponds to the sea, and the domain corresponds to the island. The domain including the component [α] has a granular (island-like) structure formed in the matrix including the components [β] and [γ]. The domain including the component [α] is present in the matrix as an independent domain. Such matrix-domain structure can be confirmed by observing the surface of the charge-transporting layer or the cross-sectional surface of the charge-transporting layer.

Observation of a state of the matrix-domain structure or determination of the domain structure can be performed by using, for example, a commercially available laser microscope, a light microscope, an electron microscope, or an atomic force microscope. Observation of the state of the matrix-domain structure or determination of the domain structure can be performed by using any of the above-mentioned microscopes at a predetermined magnification.

The number average particle size of the domain including the component [α] in the present invention is preferably not less than 100 nm and not more than 1,000 nm. Further, the particle size distribution of the particle sizes of each domain is preferably narrow from the viewpoint of sustained effect of reducing contact stress. The number average particle size in the present invention is determined by arbitrarily selecting 100 of domains confirmed by observing the cross-sectional surface obtained by vertically cutting the charge-transporting layer of the present invention by the above-mentioned microscope. Then, the maximum diameters of the respective cut domains are measured and averaged to calculate the number average particle size of each domain. It should be noted that if the cross-sectional surface of the charge-transporting layer is observed by the microscope, image information in a depth direction can be obtained to provide a three-dimensional image of the charge-transporting layer.

In order to form the matrix-domain structure in the present invention, the content of the siloxane moiety in the polycarbonate resin A which is the component [α] is preferably not less than 1% by mass and not more than 20% by mass relative to the total mass of whole resins in the charge-transporting layer. Moreover, from the viewpoint of a balance between sustained reduction of contact stress and potential stability in repeated use, the content of the siloxane moiety in the polycarbonate resin A which is the component [α] is preferably not less than 1% by mass and not more than 20% by mass relative to the total mass of whole resins in the charge-transporting layer. Further, the content is more preferably not less than 2% by mass and not more than 10% by mass, and the sustained reduction of contact stress and potential stability in repeated use can further be enhanced.

The matrix-domain structure of the charge-transporting layer in the electrophotographic photosensitive member of the present invention can be formed by using a charge-transporting-layer coating solution which contains the components [α], [β], and [γ]. In addition, the electrophotographic photosensitive member of the present invention can be manufactured by applying the charge-transporting-layer coating solution on the charge-generating layer and drying the solution.

The matrix-domain structure of the present invention is a structure in which the domain including the component [α] is formed in the matrix including the components [β] and [γ]. It is considered that the effect of reducing contact stress is sustainably exerted by forming the domain including the component [α] not only on the surface of the charge-transporting layer but also in the charge-transporting layer. Specifically, this is probably because the siloxane resin component having an effect of reducing contact stress, which is reduced by a friction of a member such as paper or a cleaning blade, can be supplied from the domain in the charge-transporting layer.

The inventors of the present invention have found that, in the case where a charge-transporting substance having a specific structure is used as the charge-transporting substance, the potential stability in repeated use may further be improved. Further, the inventors have estimated the reason of further enhancement of the potential stability in repeated use in an electrophotographic photosensitive member containing the specific charge-transporting substance (the component [γ]) of the present invention, as follows.

In the electrophotographic photosensitive member including the charge-transporting layer having the matrix-domain structure of the present invention, it is important to reduce the charge-transporting substance content in the domain of the formed matrix-domain structure as much as possible for suppressing a potential variation in repeated use. In the case where compatibility between the charge-transporting substance and a resin integrated with the siloxane structure which forms the domain is high, the charge-transporting substance content in the domain becomes high, and charges are captured in the charge-transporting substance in the domain in repeated use of the photosensitive member, resulting in insufficient potential stability.

In order to achieve an excellent balance between potential stability in repeated use and sustained reduction of contact stress in the electrophotographic photosensitive member containing the charge-transporting substance having a specific structure, it is necessary to improve the property by a resin integrated with the siloxane structure. The component [γ] in the present invention is a charge-transporting substance having high compatibility with the resin in the charge-transporting layer, and aggregates of the component [γ] may be easy to form because the component [γ] is contained in a large amount in the domain including the siloxane-containing resin.

In the present invention, excellent charge-transporting ability can be maintained by forming a domain including the component [α] of the present invention in the electrophotographic photosensitive member including the component [γ]. This is probably because the content of the component [γ] (specific charge-transporting substance) in the domain is reduced by forming the domain including the component [α]. This is probably because a branched siloxane structure in the polycarbonate resin A which is the component [α] can suppress remaining of the component [γ] (specific charge-transporting substance) having a structure compatible with the resin in the domain.

<Component [γ]>

The component [γ] of the present invention is at least one charge-transporting substance selected from the group consisting of a compound represented by the following formula (1) and a compound represented by the following formula (1').

(1)

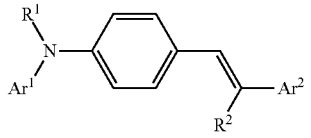

(1')

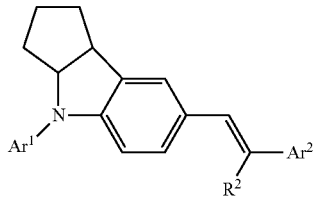

In the formulae (1) and (1'), $Ar^1$ represents a phenyl group, or a phenyl group substituted with a methyl group or an ethyl group. $Ar^2$ represents a phenyl group, a phenyl group substituted with a methyl group, a phenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), or a biphenyl group substituted with an univalent group represented by the formula "—CH═CH—Ta". $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represents a phenyl group or a phenyl group substituted with a methyl group). $R^2$ represents a hydrogen atom, a phenyl group, or a phenyl group substituted with a methyl group.

Specific examples of the charge-transporting substance which is the component [γ] and has the structure represented by the above-mentioned formula (1) or (1') are shown below.

(1-1)

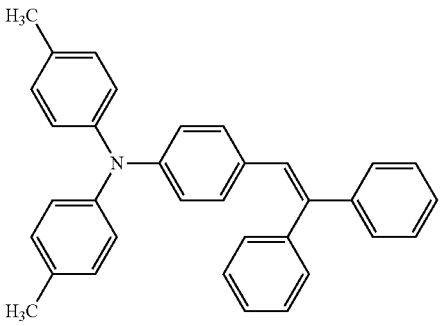

(1-2)

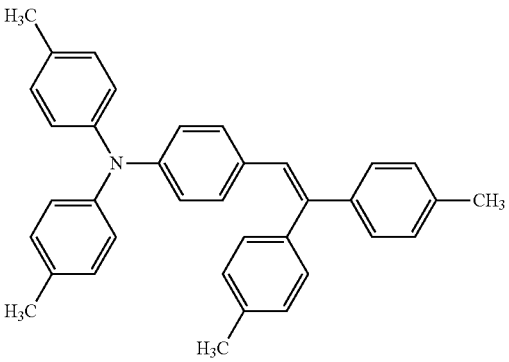

(1-3)

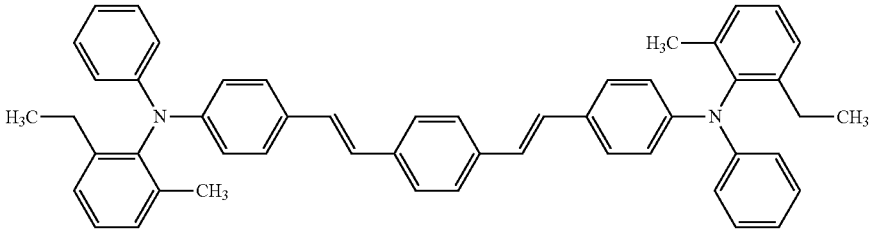

-continued
(1-4)
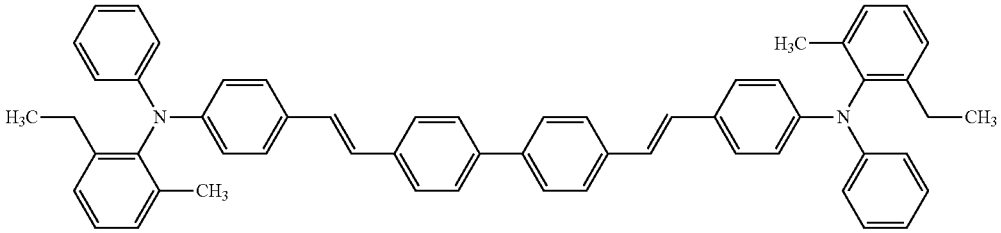
(1-5)
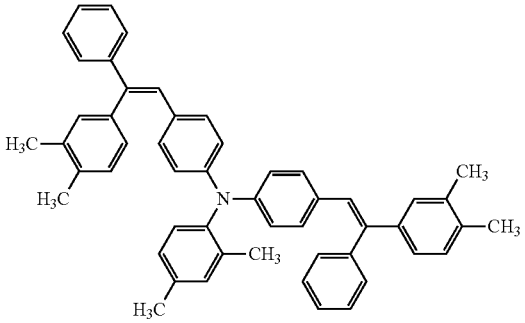
(1-6)
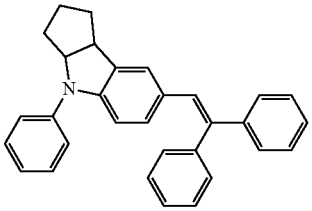
(1-7)
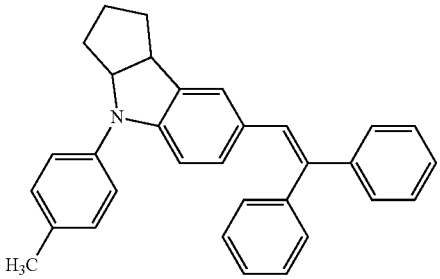
(1-8)
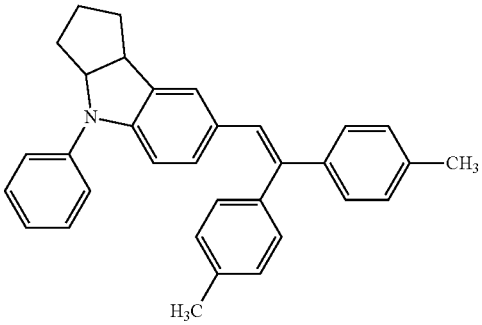
(1-9)
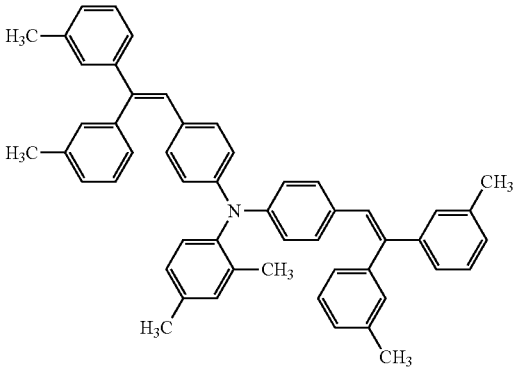
(1-10)
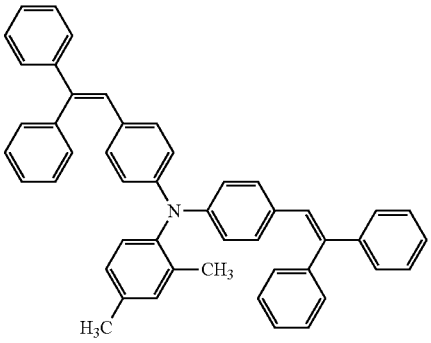

Of those, the component [γ] is preferably a charge-transporting substance having the structure represented by the above-mentioned formula (1-1), (1-3), (1-5), or (1-7).

<Component [α]>

The component [α] of the present invention is a polycarbonate resin A having a repeating structural unit represented by the following formula (A) and a repeating structural unit represented by the following formula (B), in which the content of a siloxane moiety in the polycarbonate resin A is not less than 5% by mass and not more than 40% by mass.

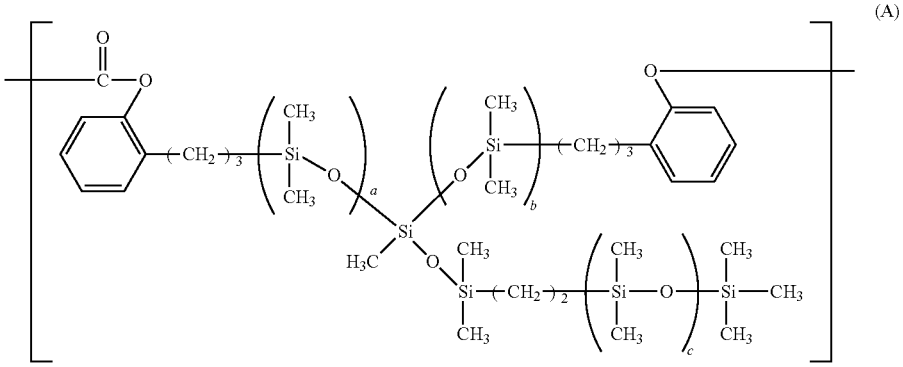

(A)

In the formula (A), "a", "b", and "c" each independently represents the number of repetitions of a structure within the brackets, an average of "a" in the polycarbonate resin A ranges from 1 to 10, an average of "b" in the polycarbonate resin A ranges from 1 to 10, and an average of "c" in the polycarbonate resin A ranges from 20 to 200.

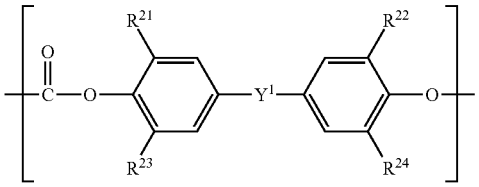

(B)

In the formula (B), $R^{21}$ to $R^{24}$ each independently represents a hydrogen atom or a methyl group. $Y^1$ represents a single bond, a methylene group, an ethylidene group, a propylidene group, a phenylethylidene group, a cyclohexylidene group, or an oxygen atom.

Hereinafter, the polycarbonate resin A which is the component [α] and has a repeating structural unit represented by the above-mentioned formula (A) and a repeating structural unit represented by the above-mentioned formula (B) is described.

In the above-mentioned formula (A), "a" and "b" each represents the number of repetitions of the structure within the brackets. The average of "a" and the average of "b" in the polycarbonate resin A each independently ranges from 1 to 10. In addition, from the viewpoint of potential stability in repeated use, each of the averages ranges more preferably from 1 to 5. In addition, the difference between the maximum value and the minimum value of the number of repetitions "a" of the structure within the brackets of each repeating structural unit ranges preferably from 0 to 2, and the difference between the maximum value and the minimum value of the number of repetitions "b" of the structure within the brackets of each repeating structural unit ranges preferably from 0 to 2. Moreover, "c" represents the number of repetitions of the structure within the brackets, and the average of "c" in the polycarbonate resin A ranges from 20 to 200. In addition, from the viewpoint of an excellent balance between sustained reduction of contact stress and the potential stability in repeated use, the average ranges more preferably from 30 to 150. Moreover, the number of repetitions "c" of the structure within the brackets in each structural unit is preferably in a range of ±10% of the value represented as the average of the number of repetitions "c" because the effect of the present invention can be obtained stably. In addition, the sum of the averages of "a", "b", and "c" ranges preferably from 30 to 200.

Table 1 shows examples of the repeating structural unit represented by the above-mentioned formula (A).

TABLE 1

| Repeating structural unit represented by formula (A) | Average of "a" | Average of "b" | Average of "c" |
|---|---|---|---|
| Example of repeating structural unit (A-1) | 1 | 1 | 40 |
| Example of repeating structural unit (A-2) | 1 | 1 | 60 |
| Example of repeating structural unit (A-3) | 1 | 1 | 80 |
| Example of repeating structural unit (A-4) | 1 | 1 | 100 |
| Example of repeating structural unit (A-5) | 1 | 1 | 150 |
| Example of repeating structural unit (A-6) | 1 | 1 | 200 |
| Example of repeating structural unit (A-7) | 1 | 1 | 30 |
| Example of repeating structural unit (A-8) | 1 | 1 | 20 |
| Example of repeating structural unit (A-9) | 5 | 5 | 40 |
| Example of repeating structural unit (A-10) | 5 | 5 | 60 |
| Example of repeating structural unit (A-11) | 10 | 10 | 20 |
| Example of repeating structural unit (A-12) | 10 | 10 | 40 |

Of those, the structural unit represented by the above-mentioned formula (A-1), (A-2), (A-3), (A-4), (A-5), (A-9), or (A-10) is preferred.

Next, the repeating structural unit represented by the above-mentioned formula (B) is described. Specific examples of the repeating structural unit represented by the above-mentioned formula (B) are shown below.

(B-1)

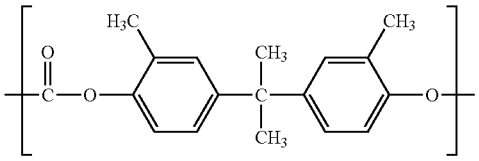

(B-2)

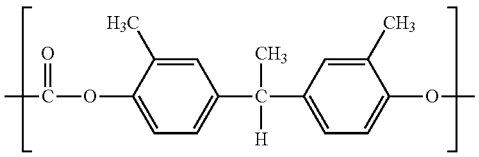

(B-3)

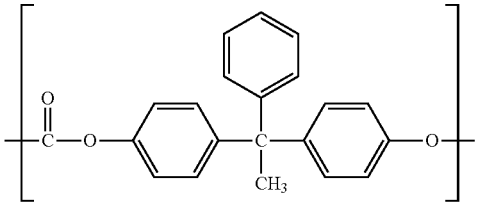

(B-4)

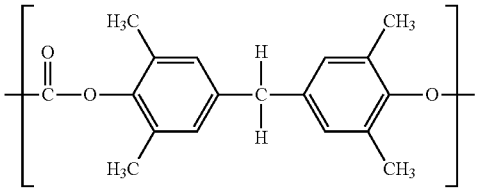

(B-5)

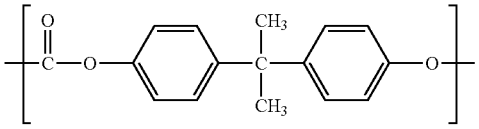

(B-6)

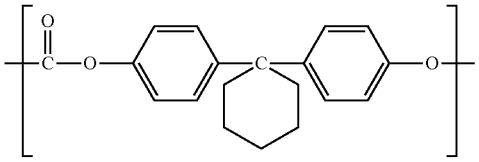

-continued (B-7)

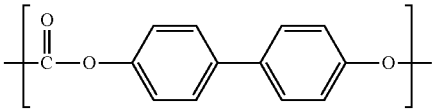

(B-8)

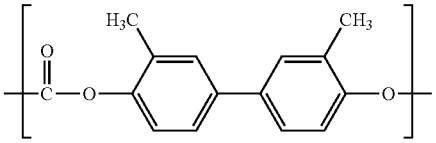

(B-9)

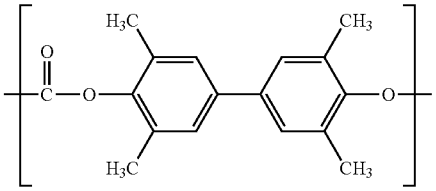

(B-10)

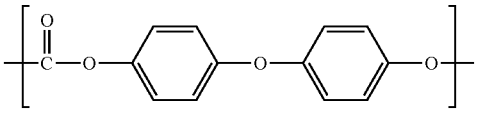

Of those, the repeating structural unit represented by the above-mentioned formula (B-1), (B-2), (B-7), (B-8), (B-9), or (B-10) is preferred.

In addition, the polycarbonate resin A which is the component [α] in the present invention contains a siloxane moiety at a content of not less than 5% by mass and not more than 40% by mass relative to the total mass of the polycarbonate resin A.

In the present invention, the siloxane moiety is a moiety which includes silicon atoms present at the both ends of the siloxane structure, groups bonded to the silicon atoms, and oxygen atoms, silicon atoms, and groups bonded to the atoms present between the silicon atoms present at the both ends. Specifically, in the present invention, the siloxane moiety refers to the moiety surrounded by the dashed line in the repeating structural unit represented by the following formula (A-S), for example.

(A-S)

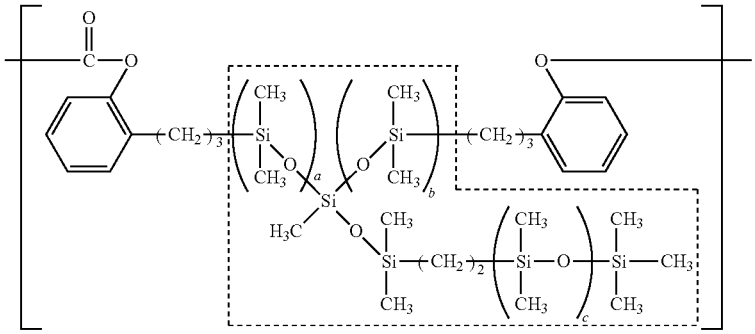

That is, the structural formula shown below represents the siloxane moiety.

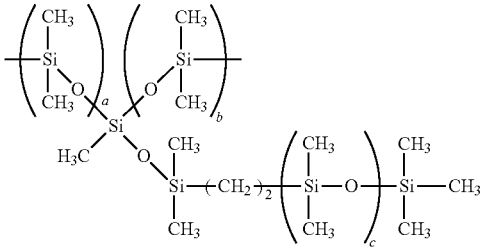

If the content of the siloxane moiety relative to the total mass of the polycarbonate resin A which is the component [α] of the present invention is not less than 5% by mass, an effect of reducing contact stress is sustainably exerted, and a domain structure is formed effectively in the matrix including the components [β] and [γ]. Meanwhile, if the content of the siloxane moiety is not more than 40% by mass, formation of aggregates of the component [γ] in the domain including the component [α] is suppressed, resulting in suppressing the potential variation in repeated use.

The content of the siloxane moiety relative to the total mass of the polycarbonate resin A which is the component [α] of the present invention can be analyzed by a general analysis technology. An example of the analysis technology is shown below.

First, the charge-transporting layer which is the surface layer of the electrophotographic photosensitive member is dissolved with a solvent. After that, a variety of materials in the charge-transporting layer which is the surface layer are fractionated using a fractionation apparatus capable of separating and collecting components, such as size exclusion chromatography or high-performance liquid chromatography. The fractionated component [α], i.e., the polycarbonate resin A is hydrolyzed in the presence of an alkali to decompose the component into a carboxylic acid moiety and a bisphenol moiety. Nuclear magnetic resonance spectrum analysis or mass spectrometry is performed for the resultant bisphenol moiety to calculate the number of repetitions of the siloxane moiety and a molar ratio, which are converted into a content (mass ratio).

The copolymerization ratio of the polycarbonate resin A which is used as the component [α] in the present invention can be determined by a general technology, i.e., by a conversion method based on a hydrogen atom (hydrogen atom which is included in the resin) peak area ratio measured by $^1$H-NMR of the resin.

The polycarbonate resin A which is used as the component [α] in the present invention can be synthesized by a conventional phosgene method, for example. The resin may also be synthesized by a transesterification method.

The polycarbonate resin A which is used as the component [α] in the present invention is the repeating structural unit represented by the above-mentioned formula (A)—the repeating structural unit represented by the above-mentioned formula (B) copolymer. In addition, the form of copolymerization may be any form such as block copolymerization, random copolymerization, or alternating copolymerization.

From the viewpoint of forming the domain structure in the matrix including the components [β] and [γ], the weight-average molecular weight of the polycarbonate resin A which is used as the component [α] in the present invention is preferably not less than 30,000 and not more than 150,000, more preferably not less than 40,000 and not more than 100,000.

In the present invention, the weight-average molecular weight of the resin is a weight-average molecular weight in terms of polystyrene measured according to a conventional method by a method described in Japanese Patent Application Laid-Open No. 2007-79555.

Synthesis examples of the polycarbonate resin A used as the component [α] in the present invention is shown below.

The above-mentioned polycarbonate resin A can be synthesized by a synthesis method described in Japanese Patent Application Laid-Open No. H10-182832. In the present invention, the components [α] (polycarbonate resins A) shown in synthesis examples in Table 2 were synthesized using raw materials corresponding to the repeating unit represented by the above-mentioned formula (A) and the structural unit represented by the above-mentioned formula (B) by the same synthesis method. Table 2 shows the weight-average molecular weights of the synthesized polycarbonate resins A and the siloxane moiety contents in the polycarbonate resins A.

TABLE 2

| | Component [α] (polycarbonate resin A) | Repeating structural unit represented by formula (A) | Repeating structural unit represented by formula (B) | Weight-average molecular weight | Siloxane moiety content in polycarbonate resin A (% by mass) |
|---|---|---|---|---|---|
| Synthesis Example 1 | Resin A (1) | (A-1) | (B-1) | 60,000 | 40 |
| Synthesis Example 2 | Resin A (2) | (A-1) | (B-1) | 60,000 | 30 |
| Synthesis Example 3 | Resin A (3) | (A-1) | (B-1) | 70,000 | 20 |
| Synthesis Example 4 | Resin A (4) | (A-1) | (B-1) | 50,000 | 10 |
| Synthesis Example 5 | Resin A (5) | (A-1) | (B-3)/(B-5) = 5/5 | 60,000 | 20 |
| Synthesis Example 6 | Resin A (6) | (A-1) | (B-5)/(B-7) = 8/2 | 40,000 | 20 |
| Synthesis Example 7 | Resin A (7) | (A-1) | (B-6) | 60,000 | 20 |
| Synthesis Example 8 | Resin A (8) | (A-1) | (B-10) | 70,000 | 20 |
| Synthesis Example 9 | Resin A (9) | (A-2) | (B-2) | 60,000 | 30 |
| Synthesis Example 10 | Resin A (10) | (A-2) | (B-2) | 60,000 | 20 |
| Synthesis Example 11 | Resin A (11) | (A-2) | (B-2) | 50,000 | 10 |
| Synthesis Example 12 | Resin A (12) | (A-2) | (B-1)/(B-8) = 8/2 | 70,000 | 20 |
| Synthesis Example 13 | Resin A (13) | (A-3) | (B-1)/(B-4) = 7/3 | 60,000 | 20 |
| Synthesis Example 14 | Resin A (14) | (A-3) | (B-1)/(B-9) = 9/1 | 80,000 | 10 |
| Synthesis Example 15 | Resin A (15) | (A-4) | (B-1) | 60,000 | 10 |
| Synthesis Example 16 | Resin A (16) | (A-4) | (B-1)/(B-10) = 7/3 | 50,000 | 5 |
| Synthesis Example 17 | Resin A (17) | (A-5) | (B-1) | 70,000 | 10 |
| Synthesis Example 18 | Resin A (18) | (A-5) | (B-1) | 60,000 | 5 |

TABLE 2-continued

| | Component [α] (polycarbonate resin A) | Repeating structural unit represented by formula (A) | Repeating structural unit represented by formula (B) | Weight-average molecular weight | Siloxane moiety content in polycarbonate resin A (% by mass) |
|---|---|---|---|---|---|
| Synthesis Example 19 | Resin A (19) | (A-6) | (B-6) | 50,000 | 10 |
| Synthesis Example 20 | Resin A (20) | (A-6) | (B-6) | 80,000 | 5 |
| Synthesis Example 21 | Resin A (21) | (A-7) | (B-1)/(B-3) = 7/3 | 40,000 | 40 |
| Synthesis Example 22 | Resin A (22) | (A-7) | (B-1)/(B-3) = 7/3 | 50,000 | 20 |
| Synthesis Example 23 | Resin A (23) | (A-8) | (B-1) | 60,000 | 40 |
| Synthesis Example 24 | Resin A (24) | (A-8) | (B-1) | 60,000 | 30 |
| Synthesis Example 25 | Resin A (25) | (A-9) | (B-1)/(B-3) = 7/3 | 50,000 | 30 |
| Synthesis Example 26 | Resin A (26) | (A-9) | (B-1)/(B-3) = 7/3 | 70,000 | 20 |
| Synthesis Example 27 | Resin A (27) | (A-10) | (B-6)/(B-10) = 7/3 | 80,000 | 30 |
| Synthesis Example 28 | Resin A (28) | (A-10) | (B-6)/(B-10) = 7/3 | 60,000 | 20 |
| Synthesis Example 29 | Resin A (29) | (A-11) | (B-1)/(B-3) = 7/3 | 50,000 | 30 |
| Synthesis Example 30 | Resin A (30) | (A-11) | (B-1)/(B-3) = 7/3 | 50,000 | 20 |
| Synthesis Example 31 | Resin A (31) | (A-12) | (B-1)/(B-3) = 7/3 | 70,000 | 20 |
| Synthesis Example 32 | Resin A (32) | (A-12) | (B-1)/(B-3) = 7/3 | 60,000 | 10 |

The difference between the maximum value and the minimum value of the number of repetitions "a" of the structure within the brackets of the repeating structural unit example (A-1) was 0, the difference between the maximum value and the minimum value of the number of repetitions "b" of the structure within the brackets of the repeating structural unit example (A-1) was 0, and the maximum value and the minimum value of the number of repetitions "c" of the structure within the brackets of the repeating structural unit example (A-1) were 42 and 38, respectively. The difference between the maximum value and the minimum value of the number of repetitions "a" of the structure within the brackets of the repeating structural unit example (A-6) was 0, the difference between the maximum value and the minimum value of the number of repetitions "b" of the structure within the brackets of the repeating structural unit example (A-6) was 0, and the maximum value and the minimum value of the number of repetitions "c" of the structure within the brackets of the repeating structural unit example (A-6) were 210 and 195, respectively. The difference between the maximum value and the minimum value of the number of repetitions "a" of the structure within the brackets of the repeating structural unit example (A-11) was 2, the difference between the maximum value and the minimum value of the number of repetitions "b" of the structure within the brackets of the repeating structural unit example (A-11) was 2, and the maximum value and the minimum value of the number of repetitions "c" of the structure within the brackets of the repeating structural unit example (A-11) were 42 and 38, respectively.

<Component [β]>

The component [β] of the present invention is at least one resin selected from the group consisting of a polycarbonate resin C having a repeating structural unit represented by the following formula (C) and a polyester resin D having a repeating structural unit represented by the following formula (D).

(C)

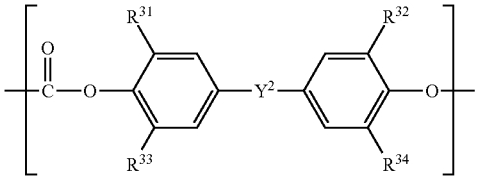

In the formula (C), $R^{31}$ to $R^{34}$ each independently represents a hydrogen atom or a methyl group. $Y^2$ represents a single bond, a methylene group, an ethylidene group, a propylidene group, a phenylethylidene group, a cyclohexylidene group, or an oxygen atom.

(D)

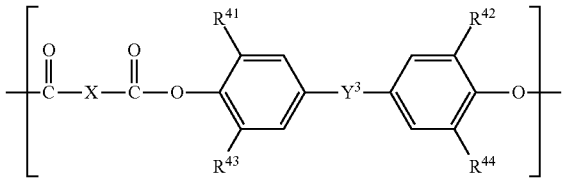

In the formula (D), $R^{41}$ to $R^{44}$ each independently represents a hydrogen atom, or a methyl group. X represents a meta-phenylene group, a para-phenylene group, or a bivalent group having two para-phenylene groups bonded with an oxygen atom. $Y^3$ represents a single bond, a methylene group, an ethylidene group, a propylidene group, a cyclohexylidene group, or an oxygen atom.

Specific examples of the repeating structural unit represented by the above-mentioned formula (C) are shown below.

(C-1)

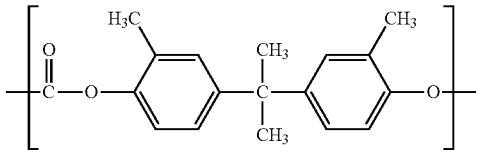

(C-2)

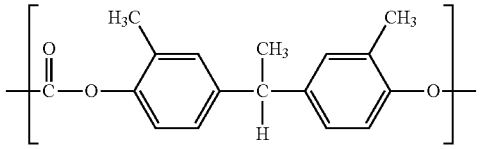

-continued
(C-3)
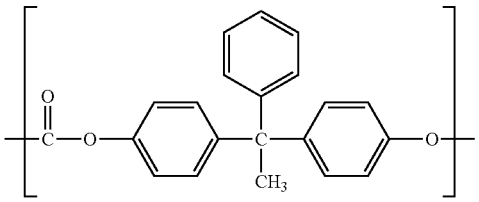
(C-4)
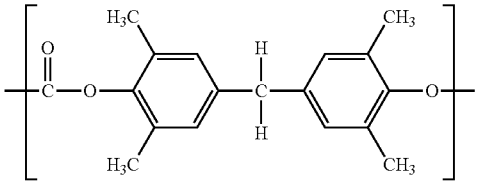
(C-5)
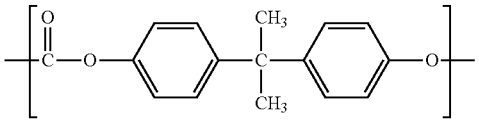
(C-6)
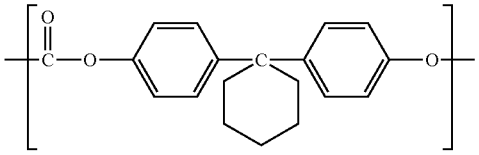
-continued
(C-7)
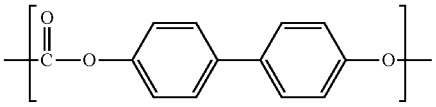
(C-8)
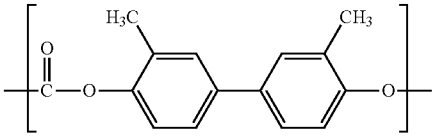
(C-9)
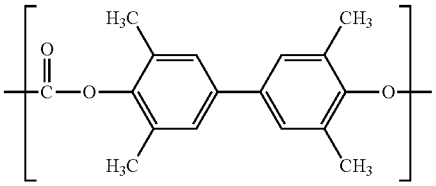
(C-10)
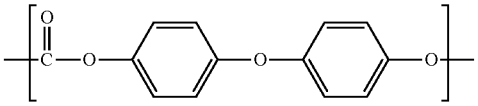
Of those, the repeating structural unit represented by the above-mentioned formula (C-1), (C-2), (C-7), (C-8), (C-9), or (C-10) is preferred.
Specific examples of the repeating structural unit represented by the above-mentioned formula (D) are shown below.
(D-1)
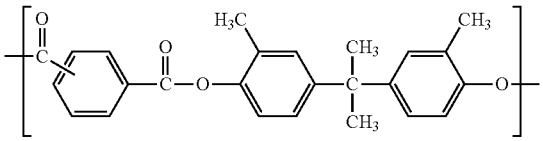
(D-2)
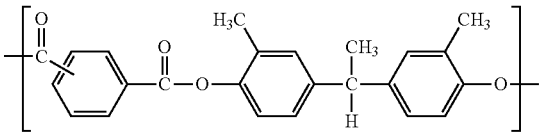
(D-3)
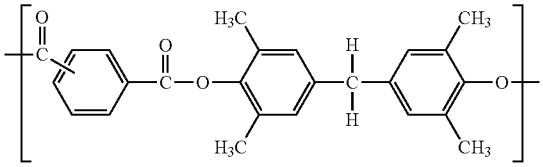
(D-4)
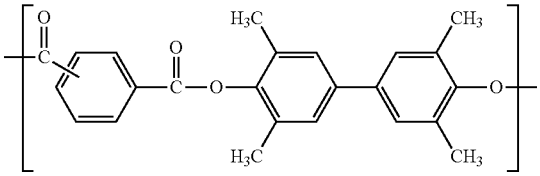
(D-5)
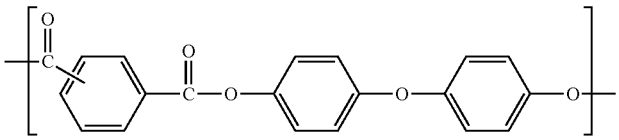
(D-6)
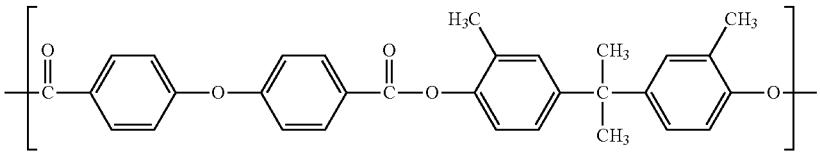

-continued (D-7)

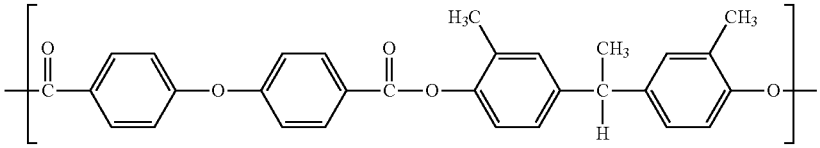

Of those, the repeating structural unit represented by the above-mentioned formula (D-1), (D-2), (D-6), or (D-7) is preferred. Further, from the viewpoint of forming a uniform matrix of the component [β] and the charge-transporting substance, the component [β] preferably has no siloxane moiety.

The charge-transporting layer which is the surface layer of the electrophotographic photosensitive member of the present invention contains the components [α] and [β] as resins, and an additional resin may be mixed therein. Examples of the additional resin which may be mixed include an acrylic resin, a polyester resin, and a polycarbonate resin. In the case where the additional resin is mixed, the ratio of the polycarbonate resin C or the polyester resin D to the additional resin is preferably in the range of 9:1 to 99:1 (mass ratio). In the present invention, in the case where the additional resin is mixed in addition to the polycarbonate resin C or the polyester resin D, from the viewpoint of forming a uniform matrix with the charge-transporting substance, the additional resin preferably has no siloxane structure.

The charge-transporting layer which is the surface layer of the electrophotographic photosensitive member of the present invention contains the component [γ] as the charge-transporting substance, and may contain a charge-transporting substance having another structure. Examples of the charge-transporting substance having another structure include a triarylamine compound and a hydrazone compound. Of those, use of the triarylamine compound as the charge-transporting substance is preferred in terms of potential stability in repeated use. In the case where a charge-transporting substance other than the component [γ] is mixed, the component [γ] is contained at a content of preferably not less than 50% by mass, more preferably not less than 70% by mass in whole charge-transporting substances in the charge-transporting layer.

Next, the construction of the electrophotographic photosensitive member of the present invention is described.

The electrophotographic photosensitive member of the present invention has a conductive support, a charge-generating layer which is provided on the conductive support and comprises a charge-generating substance, and a charge-transporting layer which is provided on the charge-generating layer, comprises a charge-transporting substance. Further, in the electrophotographic photosensitive member, the charge-transporting layer is a surface layer (outermost layer) of the electrophotographic photosensitive member.

Further, the charge-transporting layer of the electrophotographic photosensitive member of the present invention includes the above-mentioned components [α], [β], and [γ].

Further, the charge-transporting layer may have a laminate structure, and in such case, the layer is formed so that at least the charge-transporting layer provided on the outermost surface has the above-mentioned matrix-domain structure.

In general, as the electrophotographic photosensitive member, a cylindrical electrophotographic photosensitive member produced by forming a photosensitive layer (charge-generating layer or charge-transporting layer) on a cylindrical conductive support is widely used, but the member may have a form of belt or sheet.

[Conductive Support]

The conductive support to be used in the present invention is preferably conductive (conductive support) and is, for example, one made of aluminum or an aluminum alloy. In the case of aluminum or an aluminum alloy, the conductive support used may be an ED tube or an EI tube or one obtained by subjecting the ED tube or the EI tube to cutting, electrolytic composite polish, or a wet- or dry-honing process. Further examples thereof include a conductive support made of a metal or a resin having formed thereon a thin film of a conductive material such as aluminum, an aluminum alloy, or an indium oxide-tin oxide alloy. Further examples thereof include a conductive support made of a metal or a resin having provided thereon a conductive layer including a resin where conductive particles such as carbon black, tin oxide particles, titanium oxide particles, or silver particles are dispersed.

Further, in order to suppress an interference fringe, it is preferred to adequately make the surface of the conductive support rough. Specifically, a conductive support obtained by processing the surface of the above-mentioned conductive support by honing, blast, cutting, or electrolytic polishing, or a conductive support having a conductive layer which includes conductive metal oxide particles and a resin on a conductive support made of aluminum or an aluminum alloy is preferably used. In order to suppress generation of an interference fringe in an output image due to interference of light reflected on the surface of the conductive layer, a surface roughness-imparting agent for making the surface of the conductive layer rough may be added to the conductive layer.

In a method of forming a conductive layer having conductive particles and resin on a conductive support, powder containing the conductive particles is contained in the conductive layer. Examples of the conductive particles include carbon black, acetylene black, metal powders made of, for example, aluminum, nickel, iron, nichrome, copper, zinc, and silver, and metal oxide powders made of, for example, conductive tin oxide and ITO.

Examples of the resin to be used in the conductive layer include a polyester resin, a polycarbonate resin, a polyvinyl butyral resin, an acrylic resin, a silicone resin, an epoxy resin, a melamine resin, a urethane resin, a phenol resin, and an alkyd resin. Those resins may be used each alone or in combination of two or more kinds thereof.

The conductive layer may be formed by dip coating or solvent application using a Meyer bar or the like. Examples of the solvent used as a conductive-layer coating solution include an ether-based solvent, an alcohol-based solvent, a ketone-based solvent, and an aromatic hydrocarbon solvent.

The film thickness of the conductive layer is preferably not less than 0.2 μm and not more than 40 μm, more preferably not less than 1 μm and not more than 35 μm, still more preferably not less than 5 μm and not more than 30 μm.

[Intermediate Layer]

The electrophotographic photosensitive member of the present invention may include an intermediate layer between the conductive support or the conductive layer and the charge-generating layer.

The intermediate layer can be formed by applying an intermediate-layer coating solution containing a resin on the conductive layer and drying or hardening the coating solution.

Examples of the resin to be used in the intermediate layer include polyacrylic acids, methylcellulose, ethylcellulose, a polyamide resin, a polyimide resin, a polyamideimide resin, a polyamide acid resin, a melamine resin, an epoxy resin, and a polyurethane resin. The resin of the intermediate layer is preferably a thermoplastic resin, more preferably a thermoplastic polyamide resin. Examples of the polyamide resin include copolymer nylon with low crystallinity or amorphous which can be applied in solution state.

The film thickness of the intermediate layer is preferably not less than 0.05 μm and not more than 40 μm, more preferably not less than 0.1 μm and not more than 7 μm.

The intermediate layer may further contain a semiconductive particle, an charge-transporting substance, or an charge-accepting substance.

[Charge-Generating Layer]

In the electrophotographic photosensitive member of the present invention, the charge-generating layer is provided on the conductive support, conductive layer, or intermediate layer.

Examples of the charge-generating substance to be used in the electrophotographic photosensitive member of the present invention include azo pigments, phthalocyanine pigments, indigo pigments, and perylene pigments. Only one kind of those charge-generating substances may be used, or two or more kinds thereof may be used. Of those, oxytitanium phthalocyanine, hydroxygallium phthalocyanine, and chlorogallium phthalocyanine are particularly preferred because of their high sensitivity.

Examples of the resin to be used in the charge-generating layer include a polycarbonate resin, a polyester resin, a butyral resin, a polyvinyl acetal resin, an acrylic resin, a vinyl acetate resin, and a urea resin. Of those, a butyral resin is particularly preferred. One kind of those resins may be used alone, or two or more kinds thereof may be used as a mixture or as a copolymer.

The charge-generating layer can be formed by applying a charge-generating-layer coating solution, which is prepared by dispersing a charge-generating substance together with a resin and a solvent, and then drying the coating solution. Further, the charge-generating layer may also be a deposited film of a charge-generating substance.

Examples of the dispersion method include those using a homogenizer, an ultrasonic wave, a ball mill, a sand mill, an attritor, or a roll mill.

A ratio between the charge-generating substance and the resin is preferably not less than 0.1 part by mass and not more than 10 parts by mass, particularly preferably not less than 1 part by mass and not more than 3 parts by mass of the charge-generating substance with respect to 1 part by mass of the resin.

Examples of the solvent to be used in the charge-generating-layer coating solution include an alcohol-based solvent, a sulfoxide-based solvent, a ketone-based solvent, an ether-based solvent, an ester-based solvent, and an aromatic hydrocarbon solvent.

The film thickness of the charge-generating layer is preferably not less than 0.01 μm and not more than 5 μm, more preferably not less than 0.1 μm and not more than 2 μm.

Further, the charge-generating layer may be added with any of various sensitizers, antioxidants, UV absorbents, plasticizers, and the like if required. A charge-transporting substance or a charge-accepting substance may also be added to the charge-generating layer to prevent the flow of charge from being disrupted in the charge-generating layer.

[Charge-Transporting Layer]

The charge-transporting layer is provided on the charge-generating layer.

The charge-transporting layer which is the surface layer of the electrophotographic photosensitive member of the present invention contains the component [γ] as a specific charge-transporting substance, and may also contain a charge-transporting substance having another structure as described above. The charge-transporting substance which has another structure and may be mixed is as described above.

The charge-transporting layer which is the surface layer of the electrophotographic photosensitive member of the present invention contains the components [α] and [β] as resins, and as described above, another resin may further be mixed. The resin which may be mixed is as described above.

The charge-transporting layer can be formed by applying a charge-transporting-layer coating solution obtained by dissolving a charge-transporting substance and the above-mentioned resins into a solvent and then drying the coating solution.

A ratio between the charge-transporting substance and the resins is preferably not less than 0.4 part by mass and not more than 2 parts by mass, more preferably not less than 0.5 part by mass and not more than 1.2 parts by mass of the charge-transporting substance with respect to 1 part by mass of the resins.

Examples of the solvent to be used for the charge-transporting-layer coating solution include ketone-based solvents, ester-based solvents, ether-based solvents, and aromatic hydrocarbon solvents. Those solvents may be used each alone or as a mixture of two or more kinds thereof. Of those solvents, it is preferred to use any of the ether-based solvents and the aromatic hydrocarbon solvents from the viewpoint of resin solubility.

The charge-transporting layer has a film thickness of preferably not less than 5 μm and not more than 50 μm, more preferably not less than 10 μm and not more than 35 μm.

In addition, the charge-transporting layer may be added with an antioxidant, a UV absorber, or a plasticizer if required.

A variety of additives may be added to each layer of the electrophotographic photosensitive member of the present invention. Examples of the additives include: a deterioration-preventing agent such as an antioxidant, a UV absorber, or a light stabilizer; and fine particles such as organic fine particles or inorganic fine particles. Examples of the deterioration-preventing agent include a hindered phenol-based antioxidant, a hindered amine-based light stabilizer, a sulfur atom-containing antioxidant, and a phosphorus atom-containing antioxidant. Examples of the organic fine particles include polymer resin particles such as fluorine atom-containing resin particles, polystyrene fine particles, and polyethylene resin particles. Examples of the inorganic fine particles include metal oxides such as silica and alumina.

For the application of each of the coating solutions corresponding to the above-mentioned respective layers, any of the application methods can be employed, such as dip coating, spraying coating, spinner coating, roller coating, Mayer bar coating, and blade coating.

[Electrophotographic Apparatus]

FIGURE schematically shows a example of the construction of an electrophotographic apparatus including a process cartridge having the electrophotographic photosensitive member of the present invention.

In FIGURE, a cylindrical electrophotographic photosensitive member 1 can be driven to rotate around an axis 2 in the direction indicated by the arrow at a predetermined peripheral speed. The surface of the rotated electrophotographic photosensitive member 1 is uniformly charged in negative at predetermined potential by a charging device (primary charging device: such as a charging roller) 3 during the process of rotation. Subsequently, the surface of the electrophotographic photosensitive member 1 receives exposure light (image exposure light) 4 which is emitted from an exposing device (not shown) such as a slit exposure or a laser-beam scanning exposure and which is intensity-modulated according to a time-series electric digital image signal of image information of purpose. In this way, electrostatic latent images corresponding to the image information of purpose are sequentially formed on the surface of the electrophotographic photosensitive member 1.

The electrostatic latent images formed on the surface of the electrophotographic photosensitive member 1 are converted into toner images by reversal development with toner included in a developer of a developing device 5. Subsequently, the toner images being formed and held on the surface of the electrophotographic photosensitive member 1 are sequentially transferred to a transfer material (such as paper) P by a transfer bias from a transferring device (such as transfer roller) 6. It should be noted that the transfer material P is taken from a transfer material supplying device (not shown) in synchronization with the rotation of the electrophotographic photosensitive member 1 and fed to a portion (contact part) between the electrophotographic photosensitive member 1 and the transferring device 6. Further, bias voltage having a polarity reverse to that of the electric charges the toner has is applied to the transferring device 6 from a bias power source (not shown).

The transfer material P which has received the transfer of the toner images is dissociated from the surface of the electrophotographic photosensitive member 1 and then introduced to a fixing device 8. The transfer material P is subjected to an image fixation of the toner images and then printed as an image-formed product (print or copy) out of the apparatus.

The surface of the electrophotographic photosensitive member 1 after the transfer of the toner images is cleaned by removal of the remaining developer (remaining toner) after the transfer by a cleaning device (such as cleaning blade) 7. Subsequently, the surface of the electrophotographic photosensitive member 1 is subjected to a neutralization process with pre-exposure light (not shown) from a pre-exposing device (not shown) and then repeatedly used in image formation. As shown in FIGURE, further, when the charging device 3 is a contact-charging device using a charging roller, the pre-exposure is not always required.

In the present invention, of the structural components including the electrophotographic photosensitive member 1, the charging device 3, the developing device 5, the transferring device 6, and the cleaning device 7 as described above, a plurality of them may be selected and housed in a container and then integrally supported as a process cartridge. In addition, the process cartridge may be designed so as to be detachably mounted on the main body of an electrophotographic apparatus such as a copying machine or a laser beam printer. In FIGURE, the electrophotographic photosensitive member 1, the charging device 3, the developing device 5, and the cleaning device 7 are integrally supported and placed in a cartridge, thereby forming a process cartridge 9. The process cartridge 9 is detachably mounted on the main body of the electrophotographic apparatus using a guiding device 10 such as a rail of the main body of the electrophotographic apparatus.

EXAMPLES

Hereinafter, the present invention is described in more detail with reference to examples and comparative examples. However, the present invention is not limited in any way to the following examples. In addition, "part(s)" means "part(s) by mass" in the examples.

Example 1

An aluminum cylinder with a diameter of 30 mm and a length of 260.5 mm was used as a conductive support.

Next, 10 parts of $SnO_2$-coated barium sulfate (conductive particle), 2 parts of titanium oxide (pigment for controlling resistance), 6 parts of a phenol resin, and 0.001 part of silicone oil (leveling agent) were used together with a mixed solvent of 4 parts of methanol and 16 parts of methoxypropanol, to thereby prepare a conductive-layer coating solution.

The conductive-layer coating solution was applied on the above-mentioned aluminum cylinder by dip coating and cured (thermally-cured) at 140° C. for 30 minutes, to thereby form a conductive layer with a film thickness of 15 μm.

Next, 3 parts of N-methoxymethylated nylon and 3 parts of copolymer nylon were dissolved in a mixed solvent of 65 parts of methanol and 30 parts of n-butanol, to thereby prepare an intermediate-layer coating solution.

The intermediate-layer coating solution was applied on the above-mentioned conductive layer by dip coating and dried at 100° C. for 10 minutes, to thereby form an intermediate layer with a film thickness of 0.7 μm.

Next, 10 parts of a hydroxygallium phthalocyanine crystal (charge-generating substance) having a crystal structure showing intense peaks at Bragg angles) (2θ±0.2°) of 7.5°, 9.9°, 16.3°, 18.6°, 25.1°, and 28.3° in CuKα characteristic X-ray diffraction were added to a solution obtained by dissolving 5 parts of a polyvinyl butyral resin (product name: S-LEC BX-1, manufactured by Sekisui Chemical Co., Ltd.) in 250 parts of cyclohexanone. The resultant mixture was dispersed by a sand mill apparatus using glass beads with a diameter of 1 mm under a 23±3° C. atmosphere for 1 hour. After dispersion, 250 parts of ethyl acetate were added to prepare a charge-generating-layer coating solution.

The charge-generating-layer coating solution was applied on the above-mentioned intermediate layer by dip coating and dried at 100° C. for 10 minutes, to thereby form a charge-generating layer with a film thickness of 0.26 μm.

Next, 10 parts of a charge-transporting substance having the structure represented by the above-mentioned formula (1-1) as the component [γ], 4 parts of the polycarbonate resin A(1) synthesized in Synthesis Example 1 as the component [α], and 6 parts of a polycarbonate resin C (weight-average molecular weight: 120,000) including the repeating structure represented by the formula (C-5) and the repeating structure represented by the formula (C-7) described above at a ratio of 8:2 as the component [β] were dissolved in a mixed solvent of 20 parts of tetrahydrofuran and 60 parts of toluene, to thereby prepare a charge-transporting-layer coating solution.

The charge-transporting-layer coating solution was applied on the above-mentioned charge-generating layer by dip coating and dried at 110° C. for 1 hour, to thereby form a charge-transporting layer with a film thickness of 16 μm. It was confirmed that the resultant charge-transporting layer contained a domain including the component [α] in a matrix including the components [β] and [γ].

Thus, an electrophotographic photosensitive member including the charge-transporting layer as the surface layer was prepared. Table 3 shows the components [α], [β], and [γ] in the resultant charge-transporting layer, the content of the siloxane moiety in the polycarbonate resin A, and the content of the siloxane moiety in the polycarbonate resin A relative to the total mass of whole resins in the charge-transporting layer.

Next, evaluation is described.

Evaluation was performed for a variation (potential variation) of bright section potentials in repeated use of 2,000 sheets of paper, torque relative values in early time and in repeated use of 2,000 sheets of paper, and observation of the surface of the electrophotographic photosensitive member in measurement of the torques.

A laser beam printer manufactured by Canon Inc. (LBP-2510), modified so as to adjust a charge potential (dark section potential) of the electrophotographic photosensitive member, was used as an evaluation apparatus. Further, a cleaning blade made of polyurethane rubber was set so as to have a contact angle of 22.5° and a contact pressure of 35 g/cm$^2$ relative to the surface of the electrophotographic photosensitive member. Evaluation was performed under an environment of a temperature of 23° C. and a relative humidity of 50%.

Evaluation of Potential Variation>

The exposure amount (image exposure amount) of a 780-nm laser light source used as an evaluation apparatus was set so that the light intensity on the surface of the electrophotographic photosensitive member was 0.3 μJ/cm$^2$. Measurement of the potentials (dark section potential and bright section potential) of the surface of the electrophotographic photosensitive member was performed at a position of a developing device after replacing the developing device by a fixture fixed so that a probe for potential measurement was located at a position of 130 mm from the end of the electrophotographic photosensitive member. The dark section potential at an unexposed part of the electrophotographic photosensitive member was set to −450 V, laser light was irradiated, and the bright section potential obtained by light attenuation from the dark section potential was measured. Further, A4-size plain paper was used to continuously output 2,000 images, and variations of the bright section potentials before and after the output were evaluated. A test chart having a printing ratio of 5% was used. The results are shown in the column "Potential variation" in Table 8.

<Evaluation of Torque Relative Value>

A driving current (current A) of a rotary motor of the electrophotographic photosensitive member was measured under the same conditions as those in the evaluation of the potential variation described above. This evaluation was performed for evaluating an amount of contact stress between the electrophotographic photosensitive member and the cleaning blade. The resultant current shows how large the amount of contact stress between the electrophotographic photosensitive member and the cleaning blade is.

Moreover, an electrophotographic photosensitive member for comparison of a torque relative value was prepared by the following method. The electrophotographic photosensitive member was prepared in the same manner as in Example 1 except that the polycarbonate resin A(1) which is the component [α] used in the charge-transporting layer of the electrophotographic photosensitive member of Example 1 was replaced by the component [β] in Table 3, and only the component [β] was used as the resin. The resultant electrophotographic photosensitive member was used as the electrophotographic photosensitive member for comparison. The resultant electrophotographic photosensitive member for comparison was used to measure a driving current (current B) of a rotary motor of the electrophotographic photosensitive member in the same manner as in Example 1.

A ratio of the driving current (current A) of the rotary motor of the electrophotographic photosensitive member containing the component [α] according to the present invention to the driving current (current B) of the rotary motor of the electrophotographic photosensitive member not containing the component [α] was calculated. The resultant value of (current A)/(current B) was compared as a torque relative value. The torque relative value represents a degree of reduction in the contact stress between the electrophotographic photosensitive member and the cleaning blade by use of the component [α]. As the torque relative value becomes smaller, the degree of reduction in the contact stress between the electrophotographic photosensitive member and the cleaning blade becomes larger. The results are shown in the column "Initial torque relative value" in Table 8.

Subsequently, A4-size plain paper was used to continuously output 2,000 images. A test chart having a printing ratio of 5% was used. After that, measurement of torque relative values after repeated use of 2,000 sheets was performed. The torque relative value after repeated use of 2,000 sheets of the paper was measured in the same manner as in the evaluation for the initial torque relative value. In this process, 2,000 sheets of the paper were used in a repetitive manner for the electrophotographic photosensitive member for comparison, and the resultant driving current of the rotary motor was used to calculate the torque relative value after repeated use of 2,000 sheets of paper. The results are shown in the column "Torque relative value after repeated use of 2,000 sheets of paper" in Table 8.

<Evaluation of Matrix-Domain Structure>

The cross-sectional surface of the charge-transporting layer, obtained by cutting the charge-transporting layer in a vertical direction with respect to the electrophotographic photosensitive member prepared by the above-mentioned method, was observed using an ultradeep profile measurement microscope VK-9500 (manufactured by KEYENCE CORPORATION). In this process, an area of 100 μm×100 μm (10,000 μm$^2$) in the surface of the electrophotographic photosensitive member was defined as a visual field and observed at an object lens magnification of 50× to measure the maximum diameter of 100 formed domains selected at random in the visual field. An average was calculated from the maximum diameter and provided as a number average particle size. Table 8 shows the results.

Examples 2 to 45

Electrophotographic photosensitive members were prepared in the same manner as in Example 1 except that the components [α], [β], and [γ] in the charge-transporting layers were replaced as shown in Table 3, and evaluated. It was confirmed that each of the resultant charge-transporting layers contains a domain including the component [α] in a matrix including the components [β] and [γ]. Table 8 shows the results.

It should be noted that the weight-average molecular weight of the polycarbonate resin C used as the component [β] was found to be as follows.

(C-5)/(C-7)=8/2: 120,000

(C-1): 100,000

Examples 46 to 90

Electrophotographic photosensitive members were prepared in the same manner as in Example 1 except that the components [α], [β], and [γ] in the charge-transporting layers were replaced as shown in Table 4, and evaluated. It was confirmed that each of the resultant charge-transporting layers contains a domain including the component [α] in a matrix including the components [β] and [γ]. Table 8 shows the results.

It should be noted that the weight-average molecular weight of the polycarbonate resin C used as the component [β] was found to be as follows.

(C-5)/(C-7)=8/2: 120,000

(C-2): 130,000

(C-3)/(C-5)=3/7: 100,000

Examples 91 to 135

Electrophotographic photosensitive members were prepared in the same manner as in Example 1 except that the components [α], [β], and [γ] in the charge-transporting layers were replaced as shown in Table 5, and evaluated. It was confirmed that each of the resultant charge-transporting layers contains a domain including the component [α] in a matrix including the components [β] and [γ]. Table 9 shows the results.

It should be noted that the weight-average molecular weight of the polycarbonate resin C used as the component [β] was found to be as follows.

(C-6)/(C-7)=8/2: 120,000

(C-1)/(C-10)=7/3: 130,000

(C-1)/(C-4)=8/2: 120,000

(C-1)/(C-8)=8/2: 100,000

(C-1)/(C-9)=8/2: 90,000

Examples 136 to 180

Electrophotographic photosensitive members were prepared in the same manner as in Example 1 except that the components [α], [β], and [γ] in the charge-transporting layers were replaced as shown in Table 6, and evaluated. It was confirmed that each of the resultant charge-transporting layers contains a domain including the component [α] in a matrix including the components [β] and [γ]. Table 9 shows the results.

It should be noted that used as the charge-transporting substance was a mixture of a charge-transporting substance having the structure represented by the following formula (2-1) and a charge-transporting substance having the structure represented by the following formula (2-2) mixed with the charge-transporting substance having the structure represented by the above-mentioned formula (1) or (1') as the component [γ].

(2-1)

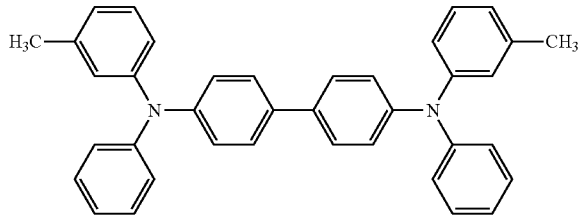

(2-2)

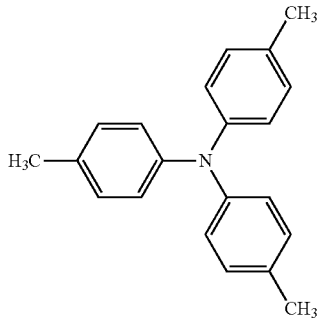

It should be noted that the weight-average molecular weight of the polyester resin D used as the component [β] was found to be as follows.

(D-1): 120,000

(D-2): 90,000

(D-1)/(D-4)=7/3: 130,000

(D-2)/(D-3)=9/1: 100,000

(D-5): 100,000

(D-6): 120,000

(D-7): 110,000

The repeating structural units represented by the above-mentioned formulae (D-1), (D-2), (D-3), (D-4), and (D-5) each have a terephthalic acid/isophthalic acid ratio of 1/1.

Comparative Examples 1 to 6

Electrophotographic photosensitive members were prepared in the same manner as in Example 1 except that the polycarbonate resin A(1) was replaced by a polycarbonate resin (E(1): weight-average molecular weight 60,000) including a repeating structural unit represented by the above-mentioned formula (A-1) and a repeating structural unit represented by the above-mentioned formula (B-1), in which the content of the siloxane moiety in the polycarbonate resin was 2% by mass, and modifications were made as shown in Table 7. Table 7 shows compositions of resins in the charge-transporting layers and the siloxane moiety contents. Evaluation was performed in the same manner as in Example 1, and Table 10 shows the results. The resultant charge-transporting layers were found to have no matrix-domain structure.

Comparative Examples 7 to 12

Electrophotographic photosensitive members were prepared in the same manner as in Example 1 except that the polycarbonate resin A(1) was replaced by the above-mentioned polycarbonate resin E(1), and modifications were made as shown in Table 7. Table 7 shows compositions of resins in the charge-transporting layers and the siloxane moiety contents. Evaluation was performed in the same manner as in Example 1, and Table 10 shows the results. The resultant charge-transporting layers were found to have no matrix-domain structure.

Comparative Example 13

An electrophotographic photosensitive member was prepared in the same manner as in Example 1 except that only the above-mentioned polycarbonate resin E(1) was used as the resin in the charge-transporting layer. Table 7 shows the composition of the resin in the charge-transporting layer and the siloxane moiety content. Evaluation was performed in the same manner as in Example 1, and Table 10 shows the results. The resultant charge-transporting layer was found to have no matrix-domain structure. It should be noted that the electrophotographic photosensitive member for comparison used in Example 1 was used as an electrophotographic photosensitive member for comparison of a torque relative value.

Comparative Examples 14 to 19

Electrophotographic photosensitive members were prepared in the same manner as in Example 1 except that the polycarbonate resin A(1) was replaced by a polycarbonate resin (E(2): weight-average molecular weight 70,000) including a repeating structural unit represented by the above-mentioned formula (A-1) and a repeating structural unit represented by the above-mentioned formula (B-1), in which the content of the siloxane moiety in the polycarbonate resin was 50% by mass, and modifications were made as shown in Table 7. Table 7 shows compositions of resins in the charge-transporting layers and the siloxane moiety contents. Evaluation was performed in the same manner as in Example 1, and Table 10 shows the results. The resultant charge-transporting layers were each found to have a matrix-domain structure.

Comparative Examples 20 to 25

Electrophotographic photosensitive members were prepared in the same manner as in Example 1 except that the polycarbonate resin A(1) was replaced by the above-mentioned polycarbonate resin E(2), and modifications were made as shown in Table 7. Table 7 shows compositions of resins in the charge-transporting layers and the siloxane moiety contents. Evaluation was performed in the same manner as in Example 1, and Table 10 shows the results. The resultant charge-transporting layers were each found to have a matrix-domain structure.

Comparative Example 26

An electrophotographic photosensitive member was prepared in the same manner as in Example 1 except that only the above-mentioned polycarbonate resin E(2) was used as the resin in the charge-transporting layer. Table 7 shows the composition of the resin in the charge-transporting layer and the siloxane moiety content. Evaluation was performed in the same manner as in Example 1, and Table 10 shows the results. The resultant charge-transporting layer was found to have no matrix-domain structure. It should be noted that the electrophotographic photosensitive member for comparison used in Example 1 was used as an electrophotographic photosensitive member for comparison of a torque relative value.

Comparative Examples 27 to 32

Electrophotographic photosensitive members were prepared in the same manner as in Example 1 except that the polycarbonate resin A(1) was replaced by a resin E(3) including a repeating structure described in Patent Literature 3, and modifications were made as shown in Table 7. The resin (E(3): weight-average molecular weight 120,000) includes a repeating structural unit represented by the following formula (E-3), a repeating structural unit represented by the above-mentioned formula (B-5), and a repeating structural unit represented by the above-mentioned formula (B-7) at a ratio of 85/14.9/0.1. The content of the siloxane moiety in the resin was found to be 1% by mass. Table 7 shows compositions of the resins in the charge-transporting layers and the siloxane moiety contents. Evaluation was performed in the same manner as in Example 1, and Table 10 shows the results. The resultant charge-transporting layers were found to have no matrix-domain structure. It should be noted that the numerical value representing the number of repetitions of the siloxane moiety in the repeating structural unit represented by the following formula (E-3) shows the average of the numbers of repetitions. In this case, the average of the numbers of repetitions of the siloxane moiety in the repeating structural unit represented by the following formula (E-3) in the resin E(3) is 25.

(E-3)

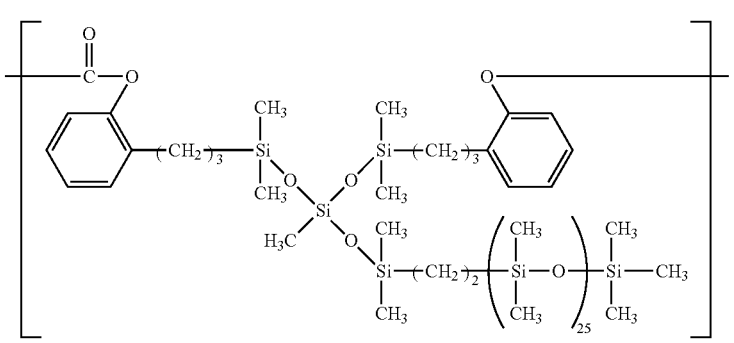

Comparative Example 33

An electrophotographic photosensitive member was prepared in the same manner as in Example 1 except that the polycarbonate resin A(1) was replaced by the above-mentioned polycarbonate resin E(3), and modifications were made as shown in Table 7. Table 7 shows the composition of the resin in the charge-transporting layer and the siloxane moiety content. Evaluation was performed in the same manner as in Example 1, and Table 10 shows the results. The resultant charge-transporting layer was found to have no matrix-domain structure.

Comparative Examples 34 to 39

Electrophotographic photosensitive members were prepared in the same manner as in Example 1 except that the polycarbonate resin A(1) was replaced by a resin (E(4): weight-average molecular weight 60,000) including a repeating structural unit represented by the following formula (E-4) which is a structure described in Patent Literature 1 and a repeating structural unit represented by the above-mentioned formula (D-1), in which the content of the siloxane moiety in the resin was 30% by mass, and modifications were made as shown in Table 7. The repeating structural units represented by the formula (E-4) and the formula (D-1) each have a terephthalic acid/isophthalic acid ratio of 1/1. Table 7 shows compositions of the resins in the charge-transporting layers and the siloxane moiety contents. Evaluation was performed in the same manner as in Example 1, and Table 10 shows the results. The resultant charge-transporting layers were each found to have a matrix-domain structure. It should be noted that the electrophotographic photosensitive member for comparison used in Example 139 was used as an electrophotographic photosensitive member for comparison of a torque relative value. It should be noted that the numerical value representing the number of repetitions of the siloxane moiety in the repeating structural unit represented by the following formula (E-4) shows the average of the numbers of repetitions. In this case, the average of the numbers of repetitions of the siloxane moiety in the repeating structural unit represented by the following formula (E-4) in the resin E(4) is 40.

(E-4)

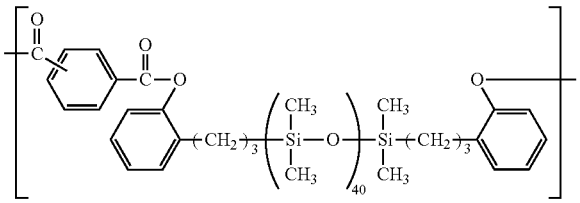

Comparative Examples 40 to 43

Electrophotographic photosensitive members were prepared in the same manner as in Example 1 except that the polycarbonate resin A(1) was replaced by the above-mentioned resin E(4), the charge-transporting substance was replaced by the substance represented by the above-mentioned formula (2-1), and modifications were made as shown in Table 7. Table 7 shows compositions of the resins in the charge-transporting layers and the siloxane moiety contents. Evaluation was performed in the same manner as in Example 1, and Table 10 shows the results. The resultant charge-transporting layers were each found to have a matrix-domain structure. It should be noted that the electrophotographic photosensitive member for comparison used in Example 139 was used as an electrophotographic photosensitive member for comparison of a torque relative value.

Comparative Examples 44 and 45

Electrophotographic photosensitive members were prepared in the same manner as in Example 1 except that the polycarbonate resin A(1) was replaced by the polycarbonate resin A(2), the charge-transporting substance was replaced by the substance represented by the above-mentioned formula (2-1), and modifications were made as shown in Table 7. Table 7 shows compositions of the resins in the charge-transporting layers and the siloxane moiety contents. Evaluation was performed in the same manner as in Example 1, and Table 10 shows the results. The resultant charge-transporting layers were each found to have a matrix-domain structure. It should be noted that the electrophotographic photosensitive member for comparison used in Example 139 was used as an electrophotographic photosensitive member for comparison of a torque relative value.

TABLE 3

| | Component [γ] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 1 | (1-1) | Resin A(1) | 40 | (C-5)/(C-7) = 8/2 | 4/6 | 16 |
| Example 2 | (1-1) | Resin A(1) | 40 | (C-5)/(C-7) = 8/2 | 3/7 | 12 |
| Example 3 | (1-1) | Resin A(1) | 40 | (C-5)/(C-7) = 8/2 | 2/8 | 8 |
| Example 4 | (1-1) | Resin A(2) | 30 | (C-1) | 3/7 | 9 |
| Example 5 | (1-1) | Resin A(2) | 30 | (C-1) | 2/8 | 6 |
| Example 6 | (1-1) | Resin A(3) | 20 | (C-1) | 3/7 | 6 |
| Example 7 | (1-1) | Resin A(3) | 20 | (C-1) | 2/8 | 4 |
| Example 8 | (1-1) | Resin A(4) | 10 | (C-5)/(C-7) = 8/2 | 3/7 | 3 |
| Example 9 | (1-1) | Resin A(4) | 10 | (C-5)/(C-7) = 8/2 | 2/8 | 2 |
| Example 10 | (1-1)/(1-2) = 7/3 | Resin A(5) | 20 | (C-5)/(C-7) = 8/2 | 3/7 | 6 |
| Example 11 | (1-1)/(1-2) = 7/3 | Resin A(6) | 20 | (C-5)/(C-7) = 8/2 | 3/7 | 6 |
| Example 12 | (1-1)/(1-2) = 7/3 | Resin A(7) | 20 | (C-5)/(C-7) = 8/2 | 3/7 | 6 |
| Example 13 | (1-1)/(1-2) = 7/3 | Resin A(8) | 20 | (C-5)/(C-7) = 8/2 | 3/7 | 6 |
| Example 14 | (1-1) | Resin A(9) | 30 | (C-5)/(C-7) = 8/2 | 4/6 | 12 |
| Example 15 | (1-1) | Resin A(9) | 30 | (C-5)/(C-7) = 8/2 | 2/8 | 6 |
| Example 16 | (1-1) | Resin A(10) | 20 | (C-5)/(C-7) = 8/2 | 3/7 | 6 |
| Example 17 | (1-1) | Resin A(10) | 20 | (C-5)/(C-7) = 8/2 | 2/8 | 4 |
| Example 18 | (1-1) | Resin A(11) | 10 | (C-5)/(C-7) = 8/2 | 3/7 | 3 |
| Example 19 | (1-1) | Resin A(11) | 10 | (C-5)/(C-7) = 8/2 | 2/8 | 2 |
| Example 20 | (1-1) | Resin A(12) | 20 | (C-1) | 3/7 | 6 |
| Example 21 | (1-1) | Resin A(13) | 20 | (C-1) | 3/7 | 6 |
| Example 22 | (1-1) | Resin A(13) | 20 | (C-1) | 2/8 | 4 |
| Example 23 | (1-1) | Resin A(14) | 10 | (C-1) | 2/8 | 2 |
| Example 24 | (1-1) | Resin A(15) | 10 | (C-1) | 2/8 | 2 |

TABLE 3-continued

| | Component [γ] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 25 | (1-1) | Resin A(16) | 5 | (C-1) | 2/8 | 1 |
| Example 26 | (1-1) | Resin A(17) | 10 | (C-5)/(C-7) = 8/2 | 2/8 | 2 |
| Example 27 | (1-1) | Resin A(18) | 5 | (C-5)/(C-7) = 8/2 | 2/8 | 1 |
| Example 28 | (1-1) | Resin A(19) | 10 | (C-5)/(C-7) = 8/2 | 2/8 | 2 |
| Example 29 | (1-1) | Resin A(20) | 5 | (C-5)/(C-7) = 8/2 | 2/8 | 1 |
| Example 30 | (1-1)/(1-2) = 7/3 | Resin A(21) | 40 | (C-5)/(C-7) = 8/2 | 5/5 | 20 |
| Example 31 | (1-1)/(1-2) = 7/3 | Resin A(21) | 40 | (C-5)/(C-7) = 8/2 | 2/8 | 8 |
| Example 32 | (1-1)/(1-2) = 7/3 | Resin A(22) | 20 | (C-5)/(C-7) = 8/2 | 4/6 | 8 |
| Example 33 | (1-1)/(1-2) = 7/3 | Resin A(22) | 20 | (C-5)/(C-7) = 8/2 | 2/8 | 4 |
| Example 34 | (1-1)/(1-2) = 7/3 | Resin A(23) | 40 | (C-5)/(C-7) = 8/2 | 5/5 | 20 |
| Example 35 | (1-1)/(1-2) = 7/3 | Resin A(23) | 40 | (C-5)/(C-7) = 8/2 | 3/7 | 8 |
| Example 36 | (1-1)/(1-2) = 7/3 | Resin A(24) | 30 | (C-5)/(C-7) = 8/2 | 5/5 | 15 |
| Example 37 | (1-1)/(1-2) = 7/3 | Resin A(24) | 30 | (C-5)/(C-7) = 8/2 | 3/7 | 9 |
| Example 38 | (1-1) | Resin A(25) | 30 | (C-1) | 3/7 | 9 |
| Example 39 | (1-1) | Resin A(26) | 20 | (C-1) | 3/7 | 6 |
| Example 40 | (1-1) | Resin A(27) | 30 | (C-1) | 3/7 | 9 |
| Example 41 | (1-1) | Resin A(28) | 20 | (C-1) | 3/7 | 6 |
| Example 42 | (1-1) | Resin A(29) | 30 | (C-1) | 3/7 | 9 |
| Example 43 | (1-1) | Resin A(30) | 20 | (C-1) | 3/7 | 6 |
| Example 44 | (1-1) | Resin A(31) | 20 | (C-1) | 3/7 | 6 |
| Example 45 | (1-1) | Resin A(32) | 10 | (C-1) | 3/7 | 3 |

The term "Component [γ]" in Tables 3 to 6 refers to the component [γ] in the charge-transporting layer. In the case of using a mixture of charge-transporting substances, the term refers to the types and mixing ratio of the component [γ] and another charge-transporting substance. The term "Component [α]" in Tables 3 to 6 refers to the composition of the component [α]. The term "Siloxane content A (% by mass)" in Tables 3 to 6 refers to the content (% by mass) of the siloxane moiety in the polycarbonate resin A. The term "Component [β]" in Tables 3 to 6 refers to the composition of the component [β]. The term "Mixing ratio of component [α] to component [β]" in Tables 3 to 6 refers to the mixing ratio (component [α]/component [β]) of the component [α] to the component [β] in the charge-transporting layer. The term "Siloxane content B (% by mass)" in Tables 3 to 6 refers to the content (% by mass) of the siloxane moiety in the polycarbonate resin A relative to the total mass of whole resins in the charge-transporting layer.

TABLE 4

| | Component [γ] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 46 | (1-1)/(1-6) = 8/2 | Resin A(1) | 40 | (C-5)/(C-7) = 8/2 | 4/6 | 16 |
| Example 47 | (1-1)/(1-6) = 8/2 | Resin A(1) | 40 | (C-5)/(C-7) = 8/2 | 3/7 | 12 |
| Example 48 | (1-1)/(1-6) = 8/2 | Resin A(1) | 40 | (C-5)/(C-7) = 8/2 | 2/8 | 8 |
| Example 49 | (1-1)/(1-6) = 8/2 | Resin A(2) | 30 | (C-2) | 3/7 | 9 |
| Example 50 | (1-1)/(1-6) = 8/2 | Resin A(2) | 30 | (C-2) | 2/8 | 6 |
| Example 51 | (1-1)/(1-6) = 8/2 | Resin A(3) | 20 | (C-2) | 3/7 | 6 |
| Example 52 | (1-1)/(1-6) = 8/2 | Resin A(3) | 20 | (C-2) | 2/8 | 4 |
| Example 53 | (1-1)/(1-6) = 8/2 | Resin A(4) | 10 | (C-5)/(C-7) = 8/2 | 3/7 | 3 |
| Example 54 | (1-1)/(1-6) = 8/2 | Resin A(4) | 10 | (C-5)/(C-7) = 8/2 | 2/8 | 2 |
| Example 55 | (1-1)/(1-8) = 7/3 | Resin A(5) | 20 | (C-5)/(C-7) = 8/2 | 3/7 | 6 |
| Example 56 | (1-1)/(1-8) = 7/3 | Resin A(6) | 20 | (C-5)/(C-7) = 8/2 | 3/7 | 6 |
| Example 57 | (1-1)/(1-8) = 7/3 | Resin A(7) | 20 | (C-5)/(C-7) = 8/2 | 3/7 | 6 |
| Example 58 | (1-1)/(1-8) = 7/3 | Resin A(8) | 20 | (C-5)/(C-7) = 8/2 | 3/7 | 6 |
| Example 59 | (1-6)/(1-7) = 5/5 | Resin A(9) | 30 | (C-5)/(C-7) = 8/2 | 4/6 | 12 |
| Example 60 | (1-6)/(1-7) = 5/5 | Resin A(9) | 30 | (C-5)/(C-7) = 8/2 | 2/8 | 6 |
| Example 61 | (1-6)/(1-7) = 5/5 | Resin A(10) | 20 | (C-5)/(C-7) = 8/2 | 3/7 | 6 |
| Example 62 | (1-6)/(1-7) = 5/5 | Resin A(10) | 20 | (C-5)/(C-7) = 8/2 | 2/8 | 4 |
| Example 63 | (1-6)/(1-7) = 5/5 | Resin A(11) | 10 | (C-5)/(C-7) = 8/2 | 3/7 | 3 |
| Example 64 | (1-6)/(1-7) = 5/5 | Resin A(11) | 10 | (C-5)/(C-7) = 8/2 | 2/8 | 2 |
| Example 65 | (1-8) | Resin A(12) | 20 | (C-3)/(C-5) = 3/7 | 3/7 | 6 |
| Example 66 | (1-8) | Resin A(13) | 20 | (C-3)/(C-5) = 3/7 | 3/7 | 6 |
| Example 67 | (1-8) | Resin A(13) | 20 | (C-3)/(C-5) = 3/7 | 2/8 | 4 |
| Example 68 | (1-8) | Resin A(14) | 10 | (C-3)/(C-5) = 3/7 | 2/8 | 2 |
| Example 69 | (1-8) | Resin A(15) | 10 | (C-3)/(C-5) = 3/7 | 2/8 | 2 |
| Example 70 | (1-8) | Resin A(16) | 5 | (C-3)/(C-5) = 3/7 | 2/8 | 1 |
| Example 71 | (1-6)/(1-7) = 5/5 | Resin A(17) | 10 | (C-5)/(C-7) = 8/2 | 2/8 | 2 |
| Example 72 | (1-6)/(1-7) = 5/5 | Resin A(18) | 5 | (C-5)/(C-7) = 8/2 | 2/8 | 1 |
| Example 73 | (1-6)/(1-7) = 5/5 | Resin A(19) | 10 | (C-5)/(C-7) = 8/2 | 2/8 | 2 |
| Example 74 | (1-6)/(1-7) = 5/5 | Resin A(20) | 5 | (C-5)/(C-7) = 8/2 | 2/8 | 1 |
| Example 75 | (1-1)/(1-8) = 7/3 | Resin A(21) | 40 | (C-5)/(C-7) = 8/2 | 5/5 | 20 |
| Example 76 | (1-1)/(1-8) = 7/3 | Resin A(21) | 40 | (C-5)/(C-7) = 8/2 | 2/8 | 8 |
| Example 77 | (1-1)/(1-8) = 7/3 | Resin A(22) | 20 | (C-5)/(C-7) = 8/2 | 4/6 | 8 |

TABLE 4-continued

| | Component [γ] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 78 | (1-1)/(1-8) = 7/3 | Resin A(22) | 20 | (C-5)/(C-7) = 8/2 | 2/8 | 4 |
| Example 79 | (1-1)/(1-8) = 7/3 | Resin A(23) | 40 | (C-5)/(C-7) = 8/2 | 5/5 | 20 |
| Example 80 | (1-1)/(1-8) = 7/3 | Resin A(23) | 40 | (C-5)/(C-7) = 8/2 | 3/7 | 8 |
| Example 81 | (1-1)/(1-8) = 7/3 | Resin A(24) | 30 | (C-5)/(C-7) = 8/2 | 5/5 | 15 |
| Example 82 | (1-1)/(1-8) = 7/3 | Resin A(24) | 30 | (C-5)/(C-7) = 8/2 | 3/7 | 9 |
| Example 83 | (1-1)/(1-8) = 7/3 | Resin A(25) | 30 | (C-2) | 3/7 | 9 |
| Example 84 | (1-1)/(1-8) = 7/3 | Resin A(26) | 20 | (C-2) | 3/7 | 6 |
| Example 85 | (1-1)/(1-8) = 7/3 | Resin A(27) | 30 | (C-2) | 3/7 | 9 |
| Example 86 | (1-1)/(1-8) = 7/3 | Resin A(28) | 20 | (C-2) | 3/7 | 6 |
| Example 87 | (1-1)/(1-8) = 7/3 | Resin A(29) | 30 | (C-2) | 3/7 | 9 |
| Example 88 | (1-1)/(1-8) = 7/3 | Resin A(30) | 20 | (C-2) | 3/7 | 6 |
| Example 89 | (1-1)/(1-8) = 7/3 | Resin A(31) | 20 | (C-2) | 3/7 | 6 |
| Example 90 | (1-1)/(1-8) = 7/3 | Resin A(32) | 10 | (C-2) | 3/7 | 3 |

TABLE 5

| | Component [γ] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 91 | (1-3) | Resin A(1) | 40 | (C-6)/(C-7) = 8/2 | 4/6 | 16 |
| Example 92 | (1-3) | Resin A(1) | 40 | (C-6)/(C-7) = 8/2 | 3/7 | 12 |
| Example 93 | (1-3) | Resin A(1) | 40 | (C-6)/(C-7) = 8/2 | 2/8 | 8 |
| Example 94 | (1-4) | Resin A(2) | 30 | (C-6)/(C-7) = 8/2 | 3/7 | 9 |
| Example 95 | (1-4) | Resin A(2) | 30 | (C-6)/(C-7) = 8/2 | 2/8 | 6 |
| Example 96 | (1-3) | Resin A(3) | 20 | (C-6)/(C-7) = 8/2 | 3/7 | 6 |
| Example 97 | (1-3) | Resin A(3) | 20 | (C-6)/(C-7) = 8/2 | 2/8 | 4 |
| Example 98 | (1-5) | Resin A(4) | 10 | (C-1)/(C-10) = 7/3 | 3/7 | 3 |
| Example 99 | (1-5) | Resin A(4) | 10 | (C-1)/(C-10) = 7/3 | 2/8 | 2 |
| Example 100 | (1-3) | Resin A(5) | 20 | (C-1)/(C-4) = 8/2 | 3/7 | 6 |
| Example 101 | (1-3) | Resin A(6) | 20 | (C-1)/(C-4) = 8/2 | 3/7 | 6 |
| Example 102 | (1-3) | Resin A(7) | 20 | (C-1)/(C-4) = 8/2 | 3/7 | 6 |
| Example 103 | (1-3) | Resin A(8) | 20 | (C-1)/(C-4) = 8/2 | 3/7 | 6 |
| Example 104 | (1-5) | Resin A(9) | 30 | (C-1)/(C-10) = 7/3 | 4/6 | 12 |
| Example 105 | (1-5) | Resin A(9) | 30 | (C-1)/(C-10) = 7/3 | 2/8 | 6 |
| Example 106 | (1-5) | Resin A(10) | 20 | (C-1)/(C-10) = 7/3 | 3/7 | 6 |
| Example 107 | (1-5) | Resin A(10) | 20 | (C-1)/(C-10) = 7/3 | 2/8 | 4 |
| Example 108 | (1-5) | Resin A(11) | 10 | (C-1)/(C-10) = 7/3 | 3/7 | 3 |
| Example 109 | (1-5) | Resin A(11) | 10 | (C-1)/(C-10) = 7/3 | 2/8 | 2 |
| Example 110 | (1-4) | Resin A(12) | 20 | (C-6)/(C-7) = 8/2 | 3/7 | 6 |
| Example 111 | (1-4) | Resin A(13) | 20 | (C-6)/(C-7) = 8/2 | 3/7 | 6 |
| Example 112 | (1-4) | Resin A(13) | 20 | (C-6)/(C-7) = 8/2 | 2/8 | 4 |
| Example 113 | (1-4) | Resin A(14) | 10 | (C-6)/(C-7) = 8/2 | 2/8 | 2 |
| Example 114 | (1-4) | Resin A(15) | 10 | (C-6)/(C-7) = 8/2 | 2/8 | 2 |
| Example 115 | (1-4) | Resin A(16) | 5 | (C-6)/(C-7) = 8/2 | 2/8 | 1 |
| Example 116 | (1-5) | Resin A(17) | 10 | (C-1)/(C-8) = 8/2 | 2/8 | 2 |
| Example 117 | (1-5) | Resin A(18) | 5 | (C-1)/(C-8) = 8/2 | 2/8 | 1 |
| Example 118 | (1-5) | Resin A(19) | 10 | (C-1)/(C-8) = 8/2 | 2/8 | 2 |
| Example 119 | (1-5) | Resin A(20) | 5 | (C-1)/(C-8) = 8/2 | 2/8 | 1 |
| Example 120 | (1-5) | Resin A(21) | 40 | (C-1)/(C-9) = 8/2 | 5/5 | 20 |
| Example 121 | (1-5) | Resin A(21) | 40 | (C-1)/(C-9) = 8/2 | 2/8 | 8 |
| Example 122 | (1-5) | Resin A(22) | 20 | (C-1)/(C-9) = 8/2 | 4/6 | 8 |
| Example 123 | (1-5) | Resin A(22) | 20 | (C-1)/(C-9) = 8/2 | 2/8 | 4 |
| Example 124 | (1-5) | Resin A(23) | 40 | (C-1)/(C-9) = 8/2 | 5/5 | 20 |
| Example 125 | (1-5) | Resin A(23) | 40 | (C-1)/(C-9) = 8/2 | 3/7 | 8 |
| Example 126 | (1-5) | Resin A(24) | 30 | (C-1)/(C-9) = 8/2 | 5/5 | 15 |
| Example 127 | (1-5) | Resin A(24) | 30 | (C-1)/(C-9) = 8/2 | 3/7 | 9 |
| Example 128 | (1-4) | Resin A(25) | 30 | (C-6)/(C-7) = 8/2 | 3/7 | 9 |
| Example 129 | (1-4) | Resin A(26) | 20 | (C-6)/(C-7) = 8/2 | 3/7 | 6 |
| Example 130 | (1-4) | Resin A(27) | 30 | (C-6)/(C-7) = 8/2 | 3/7 | 9 |
| Example 131 | (1-4) | Resin A(28) | 20 | (C-6)/(C-7) = 8/2 | 3/7 | 6 |
| Example 132 | (1-4) | Resin A(29) | 30 | (C-6)/(C-7) = 8/2 | 3/7 | 9 |
| Example 133 | (1-4) | Resin A(30) | 20 | (C-6)/(C-7) = 8/2 | 3/7 | 6 |
| Example 134 | (1-4) | Resin A(31) | 20 | (C-6)/(C-7) = 8/2 | 3/7 | 6 |
| Example 135 | (1-4) | Resin A(32) | 10 | (C-6)/(C-7) = 8/2 | 3/7 | 3 |

TABLE 6

| | Component [γ] (Charge-transporting substance) | Component [α] | Siloxane content A (% by mass) | Component [β] | Mixing ratio of component [α] to component [β] | Siloxane content B (% by mass) |
|---|---|---|---|---|---|---|
| Example 136 | (1-1)/(2-1) = 8/2 | Resin A(1) | 40 | (D-2) | 4/6 | 16 |
| Example 137 | (1-1)/(2-1) = 8/2 | Resin A(1) | 40 | (D-2) | 3/7 | 12 |
| Example 138 | (1-1)/(2-1) = 8/2 | Resin A(1) | 40 | (D-2) | 2/8 | 8 |
| Example 139 | (1-1)/(2-1) = 8/2 | Resin A(2) | 30 | (D-1) | 3/7 | 9 |
| Example 140 | (1-1)/(2-1) = 8/2 | Resin A(2) | 30 | (D-1) | 2/8 | 6 |
| Example 141 | (1-1)/(2-1) = 8/2 | Resin A(3) | 20 | (D-1) | 3/7 | 6 |
| Example 142 | (1-1)/(2-1) = 8/2 | Resin A(3) | 20 | (D-1) | 2/8 | 4 |
| Example 143 | (1-1)/(2-1) = 8/2 | Resin A(4) | 10 | (D-1)/(D-4)7/3 | 3/7 | 3 |
| Example 144 | (1-1)/(2-1) = 8/2 | Resin A(4) | 10 | (D-1)/(D-4)7/3 | 2/8 | 2 |
| Example 145 | (1-1)/(2-1) = 8/2 | Resin A(5) | 20 | (D-1)/(D-4)7/3 | 3/7 | 6 |
| Example 146 | (1-1)/(2-1) = 8/2 | Resin A(6) | 20 | (D-1)/(D-4)7/3 | 3/7 | 6 |
| Example 147 | (1-1)/(2-1) = 8/2 | Resin A(7) | 20 | (D-1)/(D-4)7/3 | 3/7 | 6 |
| Example 148 | (1-1)/(2-1) = 8/2 | Resin A(8) | 20 | (D-1)/(D-4)7/3 | 3/7 | 6 |
| Example 149 | (1-1)/(2-1) = 8/2 | Resin A(9) | 30 | (D-2)/(D-3)9/1 | 4/6 | 12 |
| Example 150 | (1-1)/(2-1) = 8/2 | Resin A(9) | 30 | (D-2)/(D-3)9/1 | 2/8 | 6 |
| Example 151 | (1-1)/(2-1) = 8/2 | Resin A(10) | 20 | (D-2)/(D-3)9/1 | 3/7 | 6 |
| Example 152 | (1-1)/(2-1) = 8/2 | Resin A(10) | 20 | (D-2)/(D-3)9/1 | 2/8 | 4 |
| Example 153 | (1-1)/(2-1) = 8/2 | Resin A(11) | 10 | (D-5) | 3/7 | 3 |
| Example 154 | (1-1)/(2-1) = 8/2 | Resin A(11) | 10 | (D-5) | 2/8 | 2 |
| Example 155 | (1-1)/(2-1) = 8/2 | Resin A(12) | 20 | (D-5) | 3/7 | 6 |
| Example 156 | (1-1)/(2-2) = 8/2 | Resin A(13) | 20 | (D-5) | 3/7 | 6 |
| Example 157 | (1-1)/(2-2) = 8/2 | Resin A(13) | 20 | (D-2) | 2/8 | 4 |
| Example 158 | (1-1)/(2-2) = 8/2 | Resin A(14) | 10 | (D-2) | 2/8 | 2 |
| Example 159 | (1-1)/(2-2) = 8/2 | Resin A(15) | 10 | (D-2) | 2/8 | 2 |
| Example 160 | (1-1)/(2-2) = 8/2 | Resin A(16) | 5 | (D-2) | 2/8 | 1 |
| Example 161 | (1-1)/(2-2) = 8/2 | Resin A(17) | 10 | (D-2) | 2/8 | 2 |
| Example 162 | (1-1)/(2-2) = 8/2 | Resin A(18) | 5 | (D-2) | 2/8 | 1 |
| Example 163 | (1-1)/(2-2) = 8/2 | Resin A(19) | 10 | (D-2) | 2/8 | 2 |
| Example 164 | (1-1)/(2-2) = 8/2 | Resin A(20) | 5 | (D-2) | 2/8 | 1 |
| Example 165 | (1-1)/(2-1) = 8/2 | Resin A(21) | 40 | (D-7) | 5/5 | 20 |
| Example 166 | (1-1)/(2-1) = 8/2 | Resin A(21) | 40 | (D-7) | 2/8 | 8 |
| Example 167 | (1-1)/(2-1) = 8/2 | Resin A(22) | 20 | (D-7) | 4/6 | 8 |
| Example 168 | (1-1)/(2-1) = 8/2 | Resin A(22) | 20 | (D-7) | 2/8 | 4 |
| Example 169 | (1-1)/(2-1) = 8/2 | Resin A(23) | 40 | (D-7) | 5/5 | 20 |
| Example 170 | (1-1)/(2-1) = 8/2 | Resin A(23) | 40 | (D-7) | 3/7 | 8 |
| Example 171 | (1-1)/(2-1) = 8/2 | Resin A(24) | 30 | (D-7) | 5/5 | 15 |
| Example 172 | (1-1)/(2-1) = 8/2 | Resin A(24) | 30 | (D-7) | 3/7 | 9 |
| Example 173 | (1-1)/(2-2) = 8/2 | Resin A(25) | 30 | (D-6) | 3/7 | 9 |
| Example 174 | (1-1)/(2-2) = 8/2 | Resin A(26) | 20 | (D-6) | 3/7 | 6 |
| Example 175 | (1-1)/(2-2) = 8/2 | Resin A(27) | 30 | (D-6) | 3/7 | 9 |
| Example 176 | (1-1)/(2-2) = 8/2 | Resin A(28) | 20 | (D-6) | 3/7 | 6 |
| Example 177 | (1-1)/(2-2) = 8/2 | Resin A(29) | 30 | (D-6) | 3/7 | 9 |
| Example 178 | (1-1)/(2-2) = 8/2 | Resin A(30) | 20 | (D-6) | 3/7 | 6 |
| Example 179 | (1-1)/(2-2) = 8/2 | Resin A(31) | 20 | (D-6) | 3/7 | 6 |
| Example 180 | (1-1)/(2-2) = 8/2 | Resin A(32) | 10 | (D-6) | 3/7 | 3 |

TABLE 7

| | Charge-transporting substance | Resin E | Siloxane content A (% by mass) | Component [β] | Mixing ratio of resin E to component [β] | Siloxane content B (% by mass) |
|---|---|---|---|---|---|---|
| Comparative Example 1 | (1-1) | Resin E(1) | 2 | (C-5)/(C-7) = 8/2 | 3/7 | 0.6 |
| Comparative Example 2 | (1-1)/(1-2) = 7/3 | Resin E(1) | 2 | (C-5)/(C-7) = 8/2 | 3/7 | 0.6 |
| Comparative Example 3 | (1-6)/(1-7) = 5/5 | Resin E(1) | 2 | (C-5)/(C-7) = 8/2 | 3/7 | 0.6 |
| Comparative Example 4 | (1-3) | Resin E(1) | 2 | (C-1)/(C-4) = 8/2 | 3/7 | 0.6 |
| Comparative Example 5 | (1-5) | Resin E(1) | 2 | (C-1)/(C-10) = 7/3 | 3/7 | 0.6 |
| Comparative Example 6 | (1-1)/(2-1) = 8/2 | Resin E(1) | 2 | (D-2) | 3/7 | 0.6 |
| Comparative Example 7 | (1-1) | Resin E(1) | 2 | (C-5)/(C-7) = 8/2 | 5/5 | 1 |
| Comparative Example 8 | (1-1)/(1-2) = 7/3 | Resin E(1) | 2 | (C-5)/(C-7) = 8/2 | 5/5 | 1 |
| Comparative Example 9 | (1-6)/(1-7) = 5/5 | Resin E(1) | 2 | (C-5)/(C-7) = 8/2 | 5/5 | 1 |
| Comparative Example 10 | (1-3) | Resin E(1) | 2 | (C-1)/(C-4) = 8/2 | 5/5 | 1 |
| Comparative Example 11 | (1-5) | Resin E(1) | 2 | (C-1)/(C-10) = 7/3 | 5/5 | 1 |
| Comparative Example 12 | (1-1)/(2-1) = 8/2 | Resin E(1) | 2 | (D-2) | 5/5 | 1 |
| Comparative Example 13 | (1-1) | Resin E(1) | 2 | — | — | 2 |
| Comparative Example 14 | (1-1) | Resin E(2) | 50 | (C-5)/(C-7) = 8/2 | 3/7 | 15 |
| Comparative Example 15 | (1-1)/(1-2) = 7/3 | Resin E(2) | 50 | (C-5)/(C-7) = 8/2 | 3/7 | 15 |
| Comparative Example 16 | (1-6)/(1-7) = 5/5 | Resin E(2) | 50 | (C-5)/(C-7) = 8/2 | 3/7 | 15 |
| Comparative Example 17 | (1-3) | Resin E(2) | 50 | (C-1)/(C-4) = 8/2 | 3/7 | 15 |
| Comparative Example 18 | (1-5) | Resin E(2) | 50 | (C-1)/(C-10) = 7/3 | 3/7 | 15 |

TABLE 7-continued

| | Charge-transporting substance | Resin E | Siloxane content A (% by mass) | Component [β] | Mixing ratio of resin E to component [β] | Siloxane content B (% by mass) |
|---|---|---|---|---|---|---|
| Comparative Example 19 | (1-1)/(2-1) = 8/2 | Resin E(2) | 50 | (D-2) | 3/7 | 15 |
| Comparative Example 20 | (1-1) | Resin E(2) | 50 | (C-5)/(C-7) = 8/2 | 1/9 | 5 |
| Comparative Example 21 | (1-1)/(1-2) = 7/3 | Resin E(2) | 50 | (C-5)/(C-7) = 8/2 | 1/9 | 5 |
| Comparative Example 22 | (1-6)/(1-7) = 5/5 | Resin E(2) | 50 | (C-5)/(C-7) = 8/2 | 1/9 | 5 |
| Comparative Example 23 | (1-3) | Resin E(2) | 50 | (C-1)/(C-4) = 8/2 | 1/9 | 5 |
| Comparative Example 24 | (1-5) | Resin E(2) | 50 | (C-1)/(C-10) = 7/3 | 1/9 | 5 |
| Comparative Example 25 | (1-1)/(2-1) = 8/2 | Resin E(2) | 50 | (D-2) | 1/9 | 5 |
| Comparative Example 26 | (1-1) | Resin E(2) | 50 | — | — | 50 |
| Comparative Example 27 | (1-1) | Resin E(3) | 1 | (C-5)/(C-7) = 8/2 | 5/5 | 0.5 |
| Comparative Example 28 | (1-1)/(1-2) = 7/3 | Resin E(3) | 1 | (C-5)/(C-7) = 8/2 | 5/5 | 0.5 |
| Comparative Example 29 | (1-6)/(1-7) = 5/5 | Resin E(3) | 1 | (C-5)/(C-7) = 8/2 | 5/5 | 0.5 |
| Comparative Example 30 | (1-3) | Resin E(3) | 1 | (C-1)/(C-4) = 8/2 | 5/5 | 0.5 |
| Comparative Example 31 | (1-5) | Resin E(3) | 1 | (C-1)/(C-10) = 7/3 | 5/5 | 0.5 |
| Comparative Example 32 | (1-1)/(2-1) = 8/2 | Resin E(3) | 1 | (D-2) | 5/5 | 0.5 |
| Comparative Example 33 | (1-1) | Resin E(3) | 1 | (C-5)/(C-7) = 8/2 | 2/8 | 0.2 |
| Comparative Example 34 | (1-1) | Resin E(4) | 30 | (C-5)/(C-7) = 8/2 | 3/7 | 9 |
| Comparative Example 35 | (1-1)/(1-2) = 7/3 | Resin E(4) | 30 | (C-5)/(C-7) = 8/2 | 3/7 | 9 |
| Comparative Example 36 | (1-6)/(1-7) = 5/5 | Resin E(4) | 30 | (C-5)/(C-7) = 8/2 | 3/7 | 9 |
| Comparative Example 37 | (1-3) | Resin E(4) | 30 | (C-1)/(C-4) = 8/2 | 3/7 | 9 |
| Comparative Example 38 | (1-5) | Resin E(4) | 30 | (C-1)/(C-10) = 7/3 | 3/7 | 9 |
| Comparative Example 39 | (1-1)/(2-1) = 8/2 | Resin E(4) | 30 | (D-2) | 3/7 | 9 |
| Comparative Example 40 | (2-1) | Resin E(4) | 30 | (C-5)/(C-7) = 8/2 | 3/7 | 9 |
| Comparative Example 41 | (2-1) | Resin E(4) | 30 | (C-1)/(C-4) = 8/2 | 3/7 | 9 |
| Comparative Example 42 | (2-1) | Resin E(4) | 30 | (C-1)/(C-10) = 7/3 | 3/7 | 9 |
| Comparative Example 43 | (2-1) | Resin E(4) | 30 | (D-2) | 3/7 | 9 |
| Comparative Example 44 | (2-1) | Resin A(2) | 30 | (C-5)/(C-7) = 8/2 | 3/7 | 9 |
| Comparative Example 45 | (2-1) | Resin A(2) | 30 | (D-2) | 3/7 | 9 |

The term "Charge-transporting substance" in Table 7 refers to the charge-transporting substance in the charge-transporting layer. In the case of using a mixture of charge-transporting substances, the term refers to the types and mixing ratio of the charge-transporting substances. The term "Resin E" in Table 7 refers to the resin E having the siloxane moiety. The term "Siloxane content A (% by mass)" in Table 7 refers to the content (% by mass) of the siloxane moiety in the "Resin E". The term "Component [β]" in Table 7 refers to the composition of the component [β]. The term "Mixing ratio of resin E to component [β]" in Table 7 refers to the mixing ratio (resin E/Component [β]) of the resin E or the polycarbonate resin A to the component [β] in the charge-transporting layer. The term "Siloxane content B (% by mass)" in Table 7 refers to the content (% by mass) of the siloxane moiety in the "Resin E" relative to the total mass of whole resins in the charge-transporting layer.

Table 8 to 10 below shows the results of evaluation in Examples 1 to 180 and Comparative Examples 1 to 45.

TABLE 8

| | Potential variation (V) | Initial torque relative value | Torque relative value after repeated use of 2,000 sheets of paper | Particle size (nm) |
|---|---|---|---|---|
| Example 1 | 10 | 0.62 | 0.68 | 450 |
| Example 2 | 8 | 0.65 | 0.70 | 320 |
| Example 3 | 5 | 0.68 | 0.73 | 270 |
| Example 4 | 8 | 0.62 | 0.68 | 400 |
| Example 5 | 5 | 0.65 | 0.72 | 300 |
| Example 6 | 5 | 0.65 | 0.70 | 320 |
| Example 7 | 5 | 0.68 | 0.78 | 180 |
| Example 8 | 5 | 0.70 | 0.80 | 200 |
| Example 9 | 5 | 0.73 | 0.83 | 150 |
| Example 10 | 5 | 0.65 | 0.70 | 320 |
| Example 11 | 8 | 0.65 | 0.70 | 320 |

TABLE 8-continued

| | Potential variation (V) | Initial torque relative value | Torque relative value after repeated use of 2,000 sheets of paper | Particle size (nm) |
|---|---|---|---|---|
| Example 12 | 8 | 0.65 | 0.70 | 320 |
| Example 13 | 5 | 0.65 | 0.70 | 320 |
| Example 14 | 10 | 0.65 | 0.70 | 450 |
| Example 15 | 8 | 0.68 | 0.73 | 280 |
| Example 16 | 8 | 0.68 | 0.75 | 320 |
| Example 17 | 5 | 0.72 | 0.77 | 250 |
| Example 18 | 5 | 0.70 | 0.75 | 240 |
| Example 19 | 5 | 0.75 | 0.82 | 200 |
| Example 20 | 5 | 0.68 | 0.75 | 320 |
| Example 21 | 10 | 0.70 | 0.75 | 450 |
| Example 22 | 8 | 0.73 | 0.80 | 350 |
| Example 23 | 8 | 0.75 | 0.82 | 280 |
| Example 24 | 15 | 0.73 | 0.78 | 400 |
| Example 25 | 10 | 0.80 | 0.88 | 280 |
| Example 26 | 20 | 0.70 | 0.78 | 500 |
| Example 27 | 10 | 0.75 | 0.80 | 350 |
| Example 28 | 30 | 0.68 | 0.73 | 750 |
| Example 29 | 20 | 0.73 | 0.78 | 500 |
| Example 30 | 25 | 0.65 | 0.72 | 550 |
| Example 31 | 10 | 0.75 | 0.80 | 200 |
| Example 32 | 8 | 0.78 | 0.85 | 250 |
| Example 33 | 5 | 0.82 | 0.88 | 180 |
| Example 34 | 10 | 0.78 | 0.85 | 240 |
| Example 35 | 5 | 0.80 | 0.88 | 160 |
| Example 36 | 5 | 0.80 | 0.85 | 200 |
| Example 37 | 5 | 0.83 | 0.90 | 160 |
| Example 38 | 15 | 0.65 | 0.72 | 350 |
| Example 39 | 10 | 0.70 | 0.77 | 300 |
| Example 40 | 25 | 0.65 | 0.70 | 550 |
| Example 41 | 15 | 0.68 | 0.73 | 400 |
| Example 42 | 20 | 0.65 | 0.72 | 400 |
| Example 43 | 15 | 0.68 | 0.77 | 350 |
| Example 44 | 28 | 0.65 | 0.70 | 600 |
| Example 45 | 20 | 0.70 | 0.75 | 400 |
| Example 46 | 15 | 0.62 | 0.68 | 450 |

TABLE 8-continued

| | Potential variation (V) | Initial torque relative value | Torque relative value after repeated use of 2,000 sheets of paper | Particle size (nm) |
|---|---|---|---|---|
| Example 47 | 10 | 0.65 | 0.70 | 320 |
| Example 48 | 8 | 0.68 | 0.73 | 270 |
| Example 49 | 8 | 0.60 | 0.65 | 420 |
| Example 50 | 10 | 0.63 | 0.70 | 320 |
| Example 51 | 10 | 0.63 | 0.68 | 340 |
| Example 52 | 5 | 0.65 | 0.75 | 200 |
| Example 53 | 8 | 0.70 | 0.80 | 200 |
| Example 54 | 5 | 0.73 | 0.83 | 150 |
| Example 55 | 8 | 0.65 | 0.70 | 320 |
| Example 56 | 10 | 0.65 | 0.70 | 320 |
| Example 57 | 10 | 0.65 | 0.70 | 320 |
| Example 58 | 10 | 0.65 | 0.70 | 320 |
| Example 59 | 13 | 0.65 | 0.70 | 450 |
| Example 60 | 10 | 0.68 | 0.73 | 280 |
| Example 61 | 13 | 0.68 | 0.75 | 320 |
| Example 62 | 8 | 0.72 | 0.77 | 250 |
| Example 63 | 8 | 0.70 | 0.75 | 240 |
| Example 64 | 5 | 0.75 | 0.82 | 200 |
| Example 65 | 8 | 0.65 | 0.73 | 370 |
| Example 66 | 15 | 0.65 | 0.70 | 500 |
| Example 67 | 10 | 0.68 | 0.75 | 400 |
| Example 68 | 10 | 0.70 | 0.80 | 330 |
| Example 69 | 20 | 0.70 | 0.75 | 450 |
| Example 70 | 15 | 0.78 | 0.85 | 330 |
| Example 71 | 23 | 0.70 | 0.78 | 500 |
| Example 72 | 15 | 0.75 | 0.80 | 350 |
| Example 73 | 30 | 0.68 | 0.73 | 750 |
| Example 74 | 23 | 0.73 | 0.78 | 500 |
| Example 75 | 28 | 0.65 | 0.72 | 550 |
| Example 76 | 13 | 0.75 | 0.80 | 200 |
| Example 77 | 10 | 0.78 | 0.85 | 250 |
| Example 78 | 8 | 0.82 | 0.88 | 180 |
| Example 79 | 13 | 0.78 | 0.85 | 240 |
| Example 80 | 8 | 0.80 | 0.88 | 160 |
| Example 81 | 8 | 0.80 | 0.85 | 200 |
| Example 82 | 5 | 0.83 | 0.90 | 160 |
| Example 83 | 20 | 0.63 | 0.70 | 370 |
| Example 84 | 15 | 0.68 | 0.75 | 320 |
| Example 85 | 28 | 0.63 | 0.68 | 570 |
| Example 86 | 18 | 0.65 | 0.70 | 420 |
| Example 87 | 23 | 0.65 | 0.70 | 420 |
| Example 88 | 18 | 0.65 | 0.70 | 370 |
| Example 89 | 28 | 0.63 | 0.68 | 620 |
| Example 90 | 25 | 0.68 | 0.73 | 420 |

TABLE 9

| | Potential variation (V) | Initial torque relative value | Torque relative value after repeated use of 2,000 sheets of paper | Particle size (nm) |
|---|---|---|---|---|
| Example 91 | 10 | 0.60 | 0.65 | 480 |
| Example 92 | 5 | 0.63 | 0.68 | 350 |
| Example 93 | 5 | 0.65 | 0.70 | 300 |
| Example 94 | 5 | 0.60 | 0.65 | 430 |
| Example 95 | 5 | 0.63 | 0.70 | 330 |
| Example 96 | 5 | 0.63 | 0.68 | 350 |
| Example 97 | 5 | 0.65 | 0.75 | 210 |
| Example 98 | 5 | 0.72 | 0.82 | 170 |
| Example 99 | 5 | 0.75 | 0.85 | 120 |
| Example 100 | 5 | 0.68 | 0.72 | 320 |
| Example 101 | 5 | 0.68 | 0.72 | 320 |
| Example 102 | 5 | 0.68 | 0.72 | 320 |
| Example 103 | 5 | 0.68 | 0.72 | 320 |
| Example 104 | 10 | 0.68 | 0.72 | 420 |
| Example 105 | 5 | 0.70 | 0.75 | 250 |
| Example 106 | 5 | 0.70 | 0.78 | 270 |
| Example 107 | 5 | 0.75 | 0.80 | 220 |
| Example 108 | 5 | 0.72 | 0.78 | 210 |

TABLE 9-continued

| | Potential variation (V) | Initial torque relative value | Torque relative value after repeated use of 2,000 sheets of paper | Particle size (nm) |
|---|---|---|---|---|
| Example 109 | 5 | 0.78 | 0.85 | 170 |
| Example 110 | 5 | 0.65 | 0.73 | 350 |
| Example 111 | 10 | 0.68 | 0.73 | 480 |
| Example 112 | 5 | 0.70 | 0.78 | 380 |
| Example 113 | 5 | 0.73 | 0.80 | 310 |
| Example 114 | 13 | 0.70 | 0.75 | 430 |
| Example 115 | 10 | 0.78 | 0.85 | 330 |
| Example 116 | 18 | 0.68 | 0.75 | 550 |
| Example 117 | 10 | 0.73 | 0.78 | 400 |
| Example 118 | 28 | 0.65 | 0.70 | 800 |
| Example 119 | 18 | 0.70 | 0.75 | 550 |
| Example 120 | 23 | 0.63 | 0.70 | 600 |
| Example 121 | 10 | 0.73 | 0.78 | 250 |
| Example 122 | 5 | 0.75 | 0.83 | 300 |
| Example 123 | 5 | 0.80 | 0.85 | 230 |
| Example 124 | 8 | 0.75 | 0.83 | 290 |
| Example 125 | 5 | 0.78 | 0.85 | 210 |
| Example 126 | 5 | 0.78 | 0.83 | 250 |
| Example 127 | 5 | 0.80 | 0.88 | 210 |
| Example 128 | 13 | 0.63 | 0.70 | 380 |
| Example 129 | 10 | 0.68 | 0.75 | 330 |
| Example 130 | 23 | 0.63 | 0.68 | 580 |
| Example 131 | 13 | 0.65 | 0.70 | 430 |
| Example 132 | 18 | 0.63 | 0.70 | 430 |
| Example 133 | 13 | 0.65 | 0.75 | 380 |
| Example 134 | 25 | 0.63 | 0.68 | 630 |
| Example 135 | 18 | 0.68 | 0.73 | 430 |
| Example 136 | 15 | 0.65 | 0.68 | 390 |
| Example 137 | 10 | 0.67 | 0.70 | 260 |
| Example 138 | 10 | 0.70 | 0.73 | 210 |
| Example 139 | 10 | 0.65 | 0.68 | 350 |
| Example 140 | 10 | 0.68 | 0.72 | 250 |
| Example 141 | 10 | 0.68 | 0.70 | 270 |
| Example 142 | 8 | 0.70 | 0.78 | 130 |
| Example 143 | 10 | 0.73 | 0.80 | 150 |
| Example 144 | 8 | 0.75 | 0.83 | 100 |
| Example 145 | 10 | 0.68 | 0.70 | 270 |
| Example 146 | 10 | 0.68 | 0.70 | 270 |
| Example 147 | 10 | 0.68 | 0.70 | 270 |
| Example 148 | 10 | 0.68 | 0.70 | 270 |
| Example 149 | 15 | 0.68 | 0.70 | 400 |
| Example 150 | 10 | 0.70 | 0.73 | 230 |
| Example 151 | 10 | 0.70 | 0.75 | 270 |
| Example 152 | 10 | 0.75 | 0.77 | 200 |
| Example 153 | 10 | 0.73 | 0.75 | 190 |
| Example 154 | 8 | 0.78 | 0.82 | 150 |
| Example 155 | 10 | 0.70 | 0.75 | 270 |
| Example 156 | 15 | 0.73 | 0.75 | 400 |
| Example 157 | 10 | 0.73 | 0.80 | 300 |
| Example 158 | 10 | 0.78 | 0.82 | 230 |
| Example 159 | 18 | 0.73 | 0.78 | 350 |
| Example 160 | 18 | 0.83 | 0.88 | 230 |
| Example 161 | 25 | 0.73 | 0.78 | 450 |
| Example 162 | 15 | 0.78 | 0.80 | 300 |
| Example 163 | 30 | 0.68 | 0.73 | 700 |
| Example 164 | 23 | 0.73 | 0.78 | 450 |
| Example 165 | 28 | 0.68 | 0.72 | 500 |
| Example 166 | 15 | 0.78 | 0.80 | 150 |
| Example 167 | 10 | 0.80 | 0.85 | 200 |
| Example 168 | 10 | 0.83 | 0.88 | 130 |
| Example 169 | 15 | 0.80 | 0.85 | 190 |
| Example 170 | 10 | 0.80 | 0.88 | 110 |
| Example 171 | 10 | 0.83 | 0.85 | 150 |
| Example 172 | 8 | 0.85 | 0.90 | 110 |
| Example 173 | 20 | 0.70 | 0.72 | 300 |
| Example 174 | 15 | 0.73 | 0.77 | 250 |
| Example 175 | 28 | 0.68 | 0.70 | 500 |
| Example 176 | 20 | 0.70 | 0.73 | 350 |
| Example 177 | 25 | 0.68 | 0.72 | 350 |
| Example 178 | 20 | 0.68 | 0.77 | 300 |
| Example 179 | 30 | 0.68 | 0.70 | 550 |
| Example 180 | 25 | 0.73 | 0.75 | 350 |

TABLE 10

| | Potential variation (V) | Initial torque relative value | Torque relative value after repeated use of 2,000 sheets of paper | Particle size (nm) |
|---|---|---|---|---|
| Comparative Example 1 | 5 | 0.93 | 0.95 | — |
| Comparative Example 2 | 5 | 0.93 | 0.95 | — |
| Comparative Example 3 | 8 | 0.93 | 0.95 | — |
| Comparative Example 4 | 5 | 0.93 | 0.97 | — |
| Comparative Example 5 | 5 | 0.95 | 0.98 | — |
| Comparative Example 6 | 8 | 0.93 | 0.95 | — |
| Comparative Example 7 | 10 | 0.90 | 0.95 | — |
| Comparative Example 8 | 10 | 0.90 | 0.95 | — |
| Comparative Example 9 | 13 | 0.90 | 0.95 | — |
| Comparative Example 10 | 10 | 0.90 | 0.97 | — |
| Comparative Example 11 | 10 | 0.93 | 0.95 | — |
| Comparative Example 12 | 10 | 0.90 | 0.93 | — |
| Comparative Example 13 | 15 | 0.90 | 0.93 | — |
| Comparative Example 14 | 150 | 0.65 | 0.70 | 1,000 |
| Comparative Example 15 | 140 | 0.65 | 0.70 | 1,000 |
| Comparative Example 16 | 170 | 0.65 | 0.70 | 1,000 |
| Comparative Example 17 | 150 | 0.65 | 0.68 | 1,050 |
| Comparative Example 18 | 150 | 0.68 | 0.73 | 950 |
| Comparative Example 19 | 180 | 0.63 | 0.67 | 1,250 |
| Comparative Example 20 | 80 | 0.65 | 0.78 | 750 |
| Comparative Example 21 | 75 | 0.65 | 0.78 | 750 |
| Comparative Example 22 | 90 | 0.65 | 0.78 | 750 |
| Comparative Example 23 | 80 | 0.65 | 0.80 | 780 |
| Comparative Example 24 | 80 | 0.68 | 0.78 | 730 |
| Comparative Example 25 | 100 | 0.65 | 0.75 | 900 |
| Comparative Example 26 | 200 | 0.60 | 0.65 | — |
| Comparative Example 27 | 5 | 0.95 | 0.98 | — |
| Comparative Example 28 | 5 | 0.95 | 0.98 | — |
| Comparative Example 29 | 8 | 0.95 | 0.98 | — |
| Comparative Example 30 | 5 | 0.95 | 0.98 | — |
| Comparative Example 31 | 5 | 0.95 | 0.98 | — |
| Comparative Example 32 | 8 | 0.93 | 0.97 | — |
| Comparative Example 33 | 5 | 0.95 | 0.98 | — |
| Comparative Example 34 | 60 | 0.68 | 0.73 | 400 |
| Comparative Example 35 | 60 | 0.68 | 0.73 | 400 |
| Comparative Example 36 | 70 | 0.68 | 0.73 | 400 |
| Comparative Example 37 | 60 | 0.70 | 0.78 | 350 |
| Comparative Example 38 | 60 | 0.68 | 0.78 | 400 |
| Comparative Example 39 | 65 | 0.65 | 0.73 | 450 |
| Comparative Example 40 | 43 | 0.68 | 0.75 | 400 |
| Comparative Example 41 | 40 | 0.68 | 0.75 | 350 |
| Comparative Example 42 | 43 | 0.68 | 0.75 | 400 |
| Comparative Example 43 | 40 | 0.65 | 0.73 | 450 |
| Comparative Example 44 | 40 | 0.68 | 0.73 | 270 |
| Comparative Example 45 | 38 | 0.65 | 0.68 | 350 |

A comparison between Examples and Comparative Examples 1 to 12 reveals that, in the case where the mass ratio of siloxane relative to the polycarbonate resin having the siloxane moiety in the charge-transporting layer is low, the effect of reducing contact stress is insufficient. This is shown by the fact that the effect of reducing the torque was not obtained at the initial time and after repeated use of 2,000 sheets of the paper in Comparative Examples 1 to 12 of this evaluation method. Further, Comparative Example 13 shows that, in the case where the mass ratio of siloxane relative to the polycarbonate resin having the siloxane moiety is low, the effect of reducing contact stress is insufficient even if the content of the siloxane-containing resin in the charge-transporting layer is increased.

A comparison between Examples and Comparative Examples 14 to 25 reveals that, in the case where the mass ratio of siloxane relative to the polycarbonate resin containing the siloxane moiety in the charge-transporting layer is high, potential stability in repeated use is significantly low. In this case, although the matrix-domain structure due to the polycarbonate resin containing the siloxane moiety is formed, the polycarbonate resin and the charge-transporting layer have excessive amounts of the siloxane structure, and hence compatibility with the charge-transporting substance is insufficient. Therefore, the effect for potential stability in repeated use is insufficient. Further, Comparative Example 26 shows that the potential stability in repeated use is significantly low. The results of Comparative Example 26 show that a large potential variation is caused even though the matrix-domain structure is not formed. That is, in Comparative Examples 14 to 26, the resultant member contains the charge-transporting substance and the resin containing excessive amounts of the siloxane structure, and hence compatibility with the charge-transporting substance may be insufficient.

A comparison between Examples and Comparative Examples 27 to 33 reveals that, as is the case with Comparative Examples 1 to 12, in the case where the mass ratio of siloxane relative to the polycarbonate resin containing the siloxane moiety in the charge-transporting layer is low, the effect of reducing contact stress is insufficient.

In Comparative Examples 34 to 39, the charge-transporting substances shown in the present invention have low potential stability in some cases even if the matrix-domain structure is formed with the resin having the siloxane structure. A comparison between Examples and Comparative Examples 34 to 39 reveals that the potential stability in repeated use can be improved by using the polycarbonate resin of the present invention. The comparison further shows that an excellent balance between sufficient effect for the potential stability and sustained reduction of contact stress can be achieved. In Comparative Examples 34 to 39, the potential stability is insufficient because the component [γ] having high compatibility with the resin in the charge-transporting layer contains a large amount of the charge-transporting substance in the domain including the siloxane-containing resin, resulting in formation of aggregates of the charge-transporting substance in the domain. However, in Examples, compatibility between the component [α] and the component [γ] of the present invention is low, and hence the content of the charge-transporting substance in the domain is reduced. Thus, it is estimated that the content of the charge-transporting substance in the domain, which is a factor for the potential variation, is reduced, to thereby reduce the potential variation. The fact that the potential stability in repeated use is improved by the compatibility between the components [α] and [γ] is suggested by the results of Comparative Examples 40 to 45. A comparison between Comparative Examples 34 to 45 and Examples reveals that a significant effect of suppressing the potential variation can be obtained in the case of forming the charge-transporting layer containing the components [α] and [γ] of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-205832, filed Sep. 14, 2010, which is hereby incorporated by reference herein in its entirety.

The invention claimed is:

1. An electrophotographic photosensitive member, comprising:

a conductive support, a charge-generating layer which is provided on the conductive support and comprises a charge-generating substance, and a charge-transporting layer which is provided on the charge-generating layer and is a surface layer of the electrophotographic photosensitive member;

wherein the charge-transporting layer has a matrix-domain structure having:

a domain comprising a polycarbonate resin A having a repeating structural unit represented by the following formula (A) and a repeating structural unit represented by the following formula (B); and a matrix comprising:

at least one resin selected from the group consisting of a polycarbonate resin C having a repeating structural unit represented by the following formula (C) and a polyester resin D having a repeating structural unit represented by the following formula (D), and at least one charge-transporting substance selected from the group consisting of a compound represented by the following formula (1) and a compound represented by the following formula (1');

wherein the content of a siloxane moiety in the polycarbonate resin A is not less than 5% by mass and not more than 40% by mass relative to the total mass of the polycarbonate resin A;

(A)

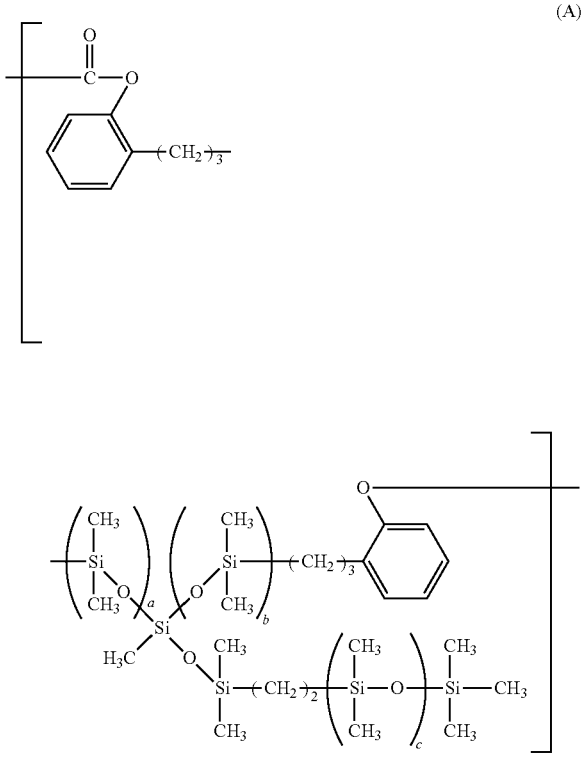

wherein, in the formula (A), "a", "b", and "c" each independently represents the number of repetitions of a structure within the brackets, an average of "a" in the polycarbonate resin A ranges from 1 to 10, an average of "b" in the polycarbonate resin A ranges from 1 to 10, and an average of "c" in the polycarbonate resin A ranges from 20 to 200;

(B)

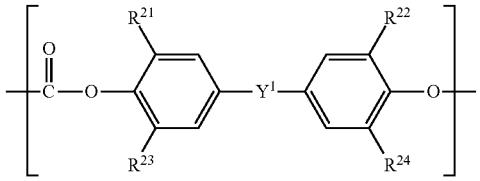

wherein, in the formula (B), $R^{21}$ to $R^{24}$ each independently represents a hydrogen atom, or a methyl group, and $Y^1$ represents a single bond, a methylene group, an ethylidene group, a propylidene group, a phenylethylidene group, a cyclohexylidene group, or an oxygen atom (C)

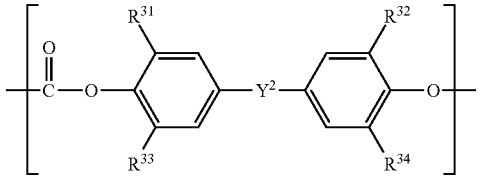

wherein, in the formula (C), $R^{31}$ to $R^{34}$ each independently represents a hydrogen atom, or a methyl group, and $Y^2$ represents a single bond, a methylene group, an ethylidene group, a propylidene group, a phenylethylidene group, a cyclohexylidene group, or an oxygen atom;

(D)

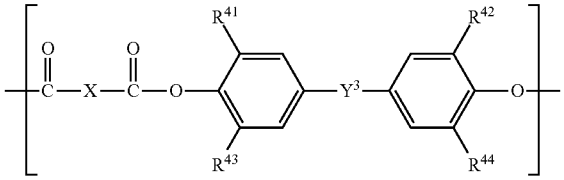

wherein, in the formula (D), $R^{41}$ to $R^{44}$ each independently represents a hydrogen atom, or a methyl group, X represents a meta-phenylene group, a para-phenylene group, or a bivalent group having two para-phenylene groups bonded with an oxygen atom, and $Y^3$ represents a single bond, a methylene group, an ethylidene group, a propylidene group, a cyclohexylidene group, or an oxygen atom; and (1)

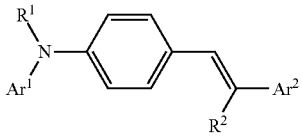

-continued (1')

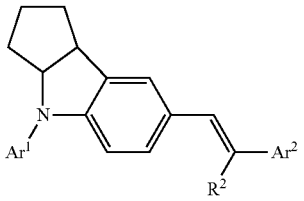

wherein, in the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with an univalent group represented by the formula "—CH═$(Ar^3)Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group.

2. The electrophotographic photosensitive member according to claim 1, wherein the content of the siloxane moiety in the charge-transporting layer is not less than 1% by mass and not more than 20% by mass relative to the total mass of whole resins in the charge-transporting layer.

3. The electrophotographic photosensitive member according to claim 1, wherein, in the formula (A), the average of "c" in the polycarbonate resin A ranges from 20 to 150.

4. A process cartridge detachably attachable to a main body of an electrophotographic apparatus, wherein the process cartridge integrally supports:

the electrophotographic photosensitive member according claim 1, and at least one device selected from the group consisting of a charging device, a developing device, a transferring device, and a cleaning device.

5. An electrophotographic apparatus, comprising: the electrophotographic photosensitive member according to claim 1; a charging device; an exposing device; a developing device; and a transferring device.

6. A method of manufacturing the electrophotographic photosensitive member according to claim 1, wherein the method comprises a step of forming the charge-transporting layer by applying a charge-transporting-layer coating solution on the charge-generating layer and drying the coating solution, and wherein the charge-transporting-layer coating solution comprises:

the polycarbonate resin A, at least one resin selected from the group consisting of the polycarbonate resin C and the polyester resin D, and at least one charge-transporting substance selected from the group consisting of the compound represented by the following formula (I) and the compound represented by the following formula (1')

(1)

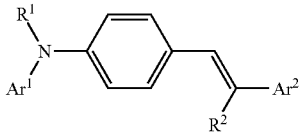

(1')

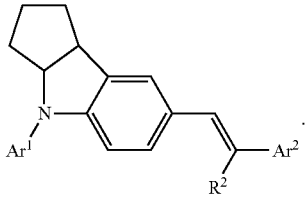

* * * * *